US010619867B2

(12) United States Patent
Vandermeulen

(10) Patent No.: US 10,619,867 B2
(45) Date of Patent: Apr. 14, 2020

(54) METHODS AND SYSTEMS FOR MINI-SPLIT LIQUID DESICCANT AIR CONDITIONING

(71) Applicant: 7AC Technologies, Inc., Beverly, MA (US)

(72) Inventor: Peter F. Vandermeulen, Newburyport, MA (US)

(73) Assignee: 7AC Technologies, Inc., Beverly, MA (US)

( * ) Notice: Subject to any disclaimer, the term of this patent is extended or adjusted under 35 U.S.C. 154(b) by 118 days.

(21) Appl. No.: 15/880,275

(22) Filed: Jan. 25, 2018

(65) Prior Publication Data

US 2018/0163977 A1 Jun. 14, 2018

Related U.S. Application Data

(62) Division of application No. 14/212,097, filed on Mar. 14, 2014, now abandoned.

(60) Provisional application No. 61/783,176, filed on Mar. 14, 2013.

(51) Int. Cl.

| | |
|---|---|
| ***F24F 3/14*** | (2006.01) |
| ***F24F 1/00*** | (2019.01) |
| ***F24F 1/0007*** | (2019.01) |

(52) U.S. Cl.

CPC ..... *F24F 3/1411* (2013.01); *F24F 1/00077* (2019.02); *F24F 3/1417* (2013.01)

(58) Field of Classification Search

CPC .... F24F 1/00077; F24F 3/1411; F24F 3/1417; F24F 3/147; F24F 11/65; F24F 2003/1458; F24F 2003/1435; F24F 2003/1452; F25B 30/04; F25B 25/005; F25B 29/006

See application file for complete search history.

(56) References Cited

U.S. PATENT DOCUMENTS

| | | | |
|---|---|---|---|
| 1,791,086 | A | 2/1931 | Sperr |
| 2,221,787 | A | 11/1940 | Downs et al. |
| 2,235,322 | A | 3/1941 | Martin |
| 2,433,741 | A | 12/1947 | Crawford |
| 2,634,958 | A | 4/1953 | Simpelaar |
| 2,660,159 | A | 11/1953 | Hughes |
| 2,708,915 | A | 5/1955 | Mandelburg |
| 2,939,686 | A | 6/1960 | Wildermuth |

(Continued)

FOREIGN PATENT DOCUMENTS

| | | | |
|---|---|---|---|
| CN | 100366981 | C | 2/2008 |
| CN | 101336358 | A | 12/2008 |

(Continued)

OTHER PUBLICATIONS

Lachner, "An Investigation into the Feasibility of the Use of Water as a Refrigerant," International Refrigeration and Air Conditioning Conference, 723:1-9 (2004).

(Continued)

*Primary Examiner* — Frantz F Jules
*Assistant Examiner* — Martha Tadesse
(74) *Attorney, Agent, or Firm* — Foley Hoag LLP; Rajesh Vallabh

(57) ABSTRACT

A split liquid desiccant air conditioning system is disclosed for treating an air stream flowing into a space in a building. The split liquid desiccant air-conditioning system is switchable between operating in a warm weather operation mode and a cold weather operation mode.

20 Claims, 13 Drawing Sheets

(56) References Cited

U.S. PATENT DOCUMENTS 2,988,171 A 6/1961 Arnold et al.
3,119,446 A 1/1964 Weiss
3,193,001 A 7/1965 Meckler
3,276,634 A 10/1966 Arnot
3,409,969 A 11/1968 Simons
3,410,581 A 11/1968 Christensen
3,455,338 A 7/1969 Pollit
3,718,181 A 2/1973 Reilly et al.
4,100,331 A 7/1978 Fletcher et al.
4,164,125 A 8/1979 Griffiths
4,176,523 A 12/1979 Rousseau
4,205,529 A 6/1980 Ko
4,209,368 A 6/1980 Coker et al.
4,222,244 A 9/1980 Meckler
4,235,221 A 11/1980 Murphy
4,239,507 A 12/1980 Benoit et al.
4,259,849 A 4/1981 Griffiths
4,324,947 A 4/1982 Dumbeck
4,399,862 A 8/1983 Hile
4,429,545 A 2/1984 Steinberg
4,435,339 A 3/1984 Kragh
4,444,992 A 4/1984 Cox, III
4,583,996 A 4/1986 Sakata et al.
4,607,132 A 8/1986 Jarnagin
4,612,019 A 9/1986 Langhorst
4,649,899 A 3/1987 Moore
4,660,390 A 4/1987 Worthington
4,691,530 A 9/1987 Meckler
4,703,629 A 11/1987 Moore
4,730,600 A 3/1988 Harrigill
4,744,414 A 5/1988 Schon
4,766,952 A 8/1988 Onodera
4,786,301 A 11/1988 Rhodes
4,832,115 A 5/1989 Albers et al.
4,872,578 A 10/1989 Fuerschbach et al.
4,882,907 A 11/1989 Brown, II
4,887,438 A 12/1989 Meckler
4,900,448 A 2/1990 Bonne et al.
4,910,971 A 3/1990 McNab
4,939,906 A 7/1990 Spatz et al.
4,941,324 A 7/1990 Peterson et al.
4,955,205 A 9/1990 Wilkinson
4,971,142 A 11/1990 Mergler
4,976,313 A 12/1990 Dahlgren et al.
4,979,965 A 12/1990 Sannholm
4,984,434 A * 1/1991 Peterson ..... F24F 3/1411 62/271
4,987,750 A 1/1991 Meckler
5,005,371 A 4/1991 Yonezawa et al.
5,181,387 A 1/1993 Meckler
5,182,921 A 2/1993 Yan
5,186,903 A 2/1993 Cornwell
5,191,771 A 3/1993 Meckler
5,221,520 A 6/1993 Cornwell
5,351,497 A 10/1994 Lowenstein
5,361,828 A 11/1994 Lee et al.
5,375,429 A 12/1994 Tokizaki et al.
5,448,895 A 9/1995 Coellner et al.
5,462,113 A 10/1995 Wand
5,471,852 A 12/1995 Meckler
5,528,905 A 6/1996 Scarlatti
5,534,186 A 7/1996 Walker et al.
5,582,026 A 12/1996 Barto, Sr.
5,595,690 A 1/1997 Filburn et al.
5,605,628 A 2/1997 Davidson et al.
5,606,865 A * 3/1997 Caron ..... F25D 1/02 62/238.1
5,638,900 A 6/1997 Lowenstein et al.
5,641,337 A 6/1997 Arrowsmith et al.
5,661,983 A 9/1997 Groten et al.
5,685,152 A 11/1997 Sterling
5,685,485 A 11/1997 Mock et al.
5,797,272 A 8/1998 James
5,816,065 A * 10/1998 Maeda ..... F24F 3/1423 62/271
5,832,993 A 11/1998 Ohata et al.
5,860,284 A 1/1999 Goland et al.
5,860,285 A 1/1999 Tulpule
5,928,808 A 7/1999 Eshraghi
5,933,702 A 8/1999 Goswami
5,950,442 A * 9/1999 Maeda ..... F24F 3/1423 62/175
6,012,296 A 1/2000 Shah
6,018,954 A 2/2000 Assaf
6,035,657 A 3/2000 Dobak, III et al.
6,083,387 A 7/2000 LeBlanc et al.
6,103,969 A 8/2000 Bussey
6,131,649 A 10/2000 Pearl et al.
6,134,903 A * 10/2000 Potnis ..... B01D 53/263 165/154
6,138,470 A 10/2000 Potnis et al.
6,156,102 A 12/2000 Conrad et al.
6,171,374 B1 1/2001 Barton et al.
6,216,483 B1 4/2001 Potnis et al.
6,216,489 B1 4/2001 Potnis et al.
6,244,062 B1 6/2001 Prado
6,247,604 B1 6/2001 Taskis et al.
6,266,975 B1 7/2001 Assaf
6,417,423 B1 7/2002 Koper et al.
6,442,951 B1 9/2002 Maeda et al.
6,463,750 B2 10/2002 Assaf
6,487,872 B1 12/2002 Forkosh et al.
6,488,900 B1 12/2002 Call et al.
6,497,107 B2 12/2002 Maisotsenko et al.
6,497,749 B2 12/2002 Kesten et al.
6,502,807 B1 1/2003 Assaf et al.
6,514,321 B1 2/2003 Lehto et al.
6,539,731 B2 4/2003 Kesten et al.
6,546,746 B2 4/2003 Forkosh et al.
6,557,365 B2 5/2003 Dinnage et al.
6,660,069 B2 12/2003 Sato et al.
6,684,649 B1 2/2004 Thompson
6,739,142 B2 5/2004 Korin
6,745,826 B2 6/2004 Lowenstein et al.
6,766,817 B2 7/2004 da Silva et al.
6,848,265 B2 2/2005 Lowenstein et al.
6,854,278 B2 2/2005 Maisotsenko et al.
6,854,279 B1 2/2005 Digiovanni et al.
6,918,404 B2 7/2005 Dias da Silva et al.
6,938,434 B1 9/2005 Fair
6,945,065 B2 9/2005 Lee et al.
6,976,365 B2 * 12/2005 Forkosh ..... F24F 3/1417 62/173
6,986,428 B2 1/2006 Hester et al.
7,066,586 B2 6/2006 da Silva et al.
RE39,288 E 9/2006 Assaf
7,143,597 B2 12/2006 Hyland et al.
7,191,821 B2 3/2007 Gronwall et al.
7,197,887 B2 4/2007 Maisotsenko et al.
7,228,891 B2 6/2007 Shin et al.
7,258,923 B2 8/2007 van den Bogerd et al.
7,269,966 B2 9/2007 Lowenstein et al.
7,279,215 B2 10/2007 Hester et al.
7,306,650 B2 12/2007 Slayzak et al.
7,337,615 B2 3/2008 Reidy
7,430,878 B2 10/2008 Assaf
7,758,671 B2 7/2010 Kesten et al.
7,930,896 B2 4/2011 Matsui et al.
7,938,888 B2 5/2011 Assaf
8,141,379 B2 * 3/2012 Al-Hadhrami ..... F24F 3/1417 62/271
8,337,590 B2 12/2012 Herencia et al.
8,353,175 B2 1/2013 Wohlert
8,496,732 B2 7/2013 Culp et al.
8,499,576 B2 8/2013 Meijer
8,500,960 B2 8/2013 Ehrenberg et al.
8,623,210 B2 1/2014 Manabe et al.
8,641,806 B2 2/2014 Claridge et al.
8,648,209 B1 2/2014 Lastella
8,695,363 B2 4/2014 Tang et al.
8,696,805 B2 4/2014 Chang et al.
8,769,971 B2 7/2014 Kozubal et al.
8,790,454 B2 7/2014 Lee et al.
8,800,308 B2 8/2014 Vandermeulen et al.

(56) References Cited

U.S. PATENT DOCUMENTS 8,876,943 B2 11/2014 Gottlieb et al.
8,881,806 B2 11/2014 Xie et al.
8,943,844 B2 * 2/2015 Forkosh ..... B01D 53/263 62/94
8,943,850 B2 2/2015 Vandermeulen et al.
8,968,945 B2 3/2015 Fasold et al.
9,000,289 B2 4/2015 Vandermeulen et al.
9,086,223 B2 7/2015 Vandermeulen et al.
9,101,874 B2 8/2015 Vandermeulen
9,101,875 B2 8/2015 Vandermeulen et al.
9,243,810 B2 1/2016 Vandermeulen et al.
9,273,877 B2 3/2016 Vandermeulen et al.
9,308,490 B2 4/2016 Vandermeulen et al.
9,377,207 B2 6/2016 Vandermeulen et al.
9,429,332 B2 8/2016 Vandermeulen et al.
9,470,426 B2 10/2016 Vandermeulen
9,506,697 B2 11/2016 Vandermeulen
9,631,823 B2 4/2017 Vandermeulen et al.
9,631,848 B2 4/2017 Vandermeulen et al.
9,709,285 B2 7/2017 Vandermeulen
9,709,286 B2 7/2017 Vandermeulen et al.
9,835,340 B2 12/2017 Vandermeulen et al.
10,006,648 B2 6/2018 Vandermeulen et al.
10,024,558 B2 7/2018 Vandermeulen
10,024,601 B2 7/2018 Vandermeulen
10,168,056 B2 1/2019 Vandermeulen
10,323,867 B2 6/2019 Vandermeulen
2001/0008148 A1 7/2001 Ito et al.
2001/0013226 A1 * 8/2001 Potnis ..... B01D 53/263 62/271
2001/0015500 A1 8/2001 Shimanuki et al.
2002/0023740 A1 2/2002 Lowenstein et al.
2002/0026797 A1 3/2002 Sundhar
2002/0038552 A1 4/2002 Maisotsenko et al.
2002/0098395 A1 7/2002 Shimanuki et al.
2002/0104439 A1 8/2002 Komkova et al.
2002/0139245 A1 10/2002 Kesten et al.
2002/0139320 A1 10/2002 Shimanuki et al.
2002/0148602 A1 10/2002 Nakamura
2003/0000230 A1 1/2003 Kopko
2003/0029185 A1 2/2003 Kopko
2003/0033821 A1 2/2003 Maisotsenko et al.
2003/0051498 A1 3/2003 Sanford
2003/0106680 A1 6/2003 Serpico et al.
2003/0121271 A1 7/2003 Dinnage et al.
2003/0230092 A1 12/2003 Lowenstein et al.
2004/0040697 A1 3/2004 Pierre et al.
2004/0061245 A1 4/2004 Maisotsenko et al.
2004/0101698 A1 5/2004 Yamanaka et al.
2004/0109798 A1 6/2004 Chopard et al.
2004/0112077 A1 * 6/2004 Forkosh ..... F24F 3/1417 62/271
2004/0118125 A1 6/2004 Potnis et al.
2004/0134212 A1 7/2004 Lee et al.
2004/0168462 A1 9/2004 Assaf
2004/0194944 A1 10/2004 Hendricks et al.
2004/0211207 A1 10/2004 Forkosh et al.
2004/0230092 A1 11/2004 Thierfelder et al.
2004/0231512 A1 11/2004 Slayzak et al.
2004/0261440 A1 12/2004 Forkosh et al.
2005/0095433 A1 5/2005 Bogerd et al.
2005/0106021 A1 5/2005 Bunker et al.
2005/0109052 A1 5/2005 Albers et al.
2005/0133082 A1 6/2005 Konold et al.
2005/0210907 A1 9/2005 Gillan et al.
2005/0217485 A1 10/2005 Olapinski et al.
2005/0218535 A1 10/2005 Maisotsenko et al.
2005/0257551 A1 11/2005 Landry
2006/0042295 A1 3/2006 Assaf
2006/0070728 A1 4/2006 Shin et al.
2006/0124287 A1 6/2006 Reinders
2006/0156750 A1 7/2006 Lowenstein et al.
2006/0156761 A1 7/2006 Mola et al.
2006/0278089 A1 12/2006 Theilow
2007/0169916 A1 7/2007 Wand et al.
2007/0175234 A1 8/2007 Pruitt
2007/0234743 A1 10/2007 Assaf
2008/0127965 A1 6/2008 Burton
2008/0156471 A1 7/2008 Han et al.
2008/0196758 A1 8/2008 McGuire
2008/0203866 A1 8/2008 Chamberlain
2008/0302357 A1 12/2008 DeNault
2008/0314567 A1 12/2008 Noren
2009/0000732 A1 1/2009 Jacobine et al.
2009/0056919 A1 3/2009 Hoffman et al.
2009/0095162 A1 4/2009 Hargis et al.
2009/0126913 A1 5/2009 Lee et al.
2009/0173096 A1 7/2009 Wohlert
2009/0183857 A1 7/2009 Pierce et al.
2009/0200022 A1 8/2009 Bravo et al.
2009/0238685 A1 9/2009 Santa Ana
2010/0000247 A1 1/2010 Bhatti et al.
2010/0012309 A1 1/2010 Uges
2010/0018322 A1 1/2010 Neitzke et al.
2010/0051083 A1 3/2010 Boyk
2010/0077783 A1 4/2010 Bhatti et al.
2010/0084120 A1 4/2010 Yin et al.
2010/0170776 A1 7/2010 Ehrenberg et al.
2010/0319370 A1 12/2010 Kozubal et al.
2011/0073290 A1 3/2011 Chang et al.
2011/0100618 A1 5/2011 Carlson
2011/0101117 A1 5/2011 Miyauchi et al.
2011/0126885 A1 6/2011 Kokotov et al.
2011/0132027 A1 6/2011 Gommed et al.
2012/0052785 A1 3/2012 Nagamatsu et al.
2012/0114527 A1 5/2012 Hoglund et al.
2012/0118148 A1 5/2012 Culp et al.
2012/0118155 A1 5/2012 Claridge et al.
2012/0125020 A1 * 5/2012 Vandermeulen ..... B01D 53/263 62/94
2012/0125021 A1 5/2012 Vandermeulen et al.
2012/0125031 A1 5/2012 Vandermeulen et al.
2012/0125581 A1 5/2012 Allen et al.
2012/0131937 A1 5/2012 Vandermeulen et al.
2012/0131938 A1 5/2012 Vandermeulen et al.
2012/0131939 A1 5/2012 Vandermeulen et al.
2012/0132513 A1 5/2012 Vandermeulen et al.
2012/0152318 A1 6/2012 Kee
2012/0186281 A1 7/2012 Vandermeulen et al.
2013/0056177 A1 3/2013 Coutu et al.
2013/0101909 A1 4/2013 Fasold et al.
2013/0186121 A1 7/2013 Erb et al.
2013/0199220 A1 8/2013 Ma et al.
2013/0227982 A1 9/2013 Forkosh
2013/0255287 A1 10/2013 Forkosh
2013/0340449 A1 12/2013 Kozubal et al.
2014/0054004 A1 2/2014 LePoudre et al.
2014/0054013 A1 2/2014 LePoudre et al.
2014/0150481 A1 6/2014 Vandermeulen
2014/0150656 A1 6/2014 Vandermeulen
2014/0150657 A1 6/2014 Vandermeulen et al.
2014/0150662 A1 6/2014 Vandermeulen et al.
2014/0223947 A1 8/2014 Ranjan et al.
2014/0245769 A1 9/2014 Vandermeulen et al.
2014/0250935 A1 9/2014 Prochaska et al.
2014/0260367 A1 9/2014 Coutu et al.
2014/0260369 A1 9/2014 LePoudre
2014/0260371 A1 9/2014 Vandermeulen
2014/0260398 A1 9/2014 Kozubal et al.
2014/0260399 A1 9/2014 Vandermeulen
2014/0262125 A1 9/2014 Erb et al.
2014/0262144 A1 9/2014 Erb et al.
2014/0264968 A1 9/2014 Erb et al.
2014/0360373 A1 12/2014 Peacos et al.
2014/0366567 A1 12/2014 Vandermeulen
2015/0107287 A1 4/2015 Forkosh
2015/0184876 A1 7/2015 Vandermeulen et al.
2015/0300754 A1 10/2015 Vandermeulen et al.
2015/0323216 A1 11/2015 Wallin
2015/0338140 A1 11/2015 Vandermeulen
2016/0187011 A1 6/2016 Vandermeulen
2016/0290665 A1 10/2016 Vandermeulen et al.
2017/0074530 A1 3/2017 Kozubal
2017/0102155 A1 4/2017 Vandermeulen

(56) References Cited

U.S. PATENT DOCUMENTS

| | | | |
|---|---|---|---|
| 2017/0106639 | A1 | 4/2017 | Vandermeulen et al. |
| 2017/0167794 | A1 | 6/2017 | Vandermeulen |
| 2017/0184319 | A1 | 6/2017 | Vandermeulen et al. |
| 2017/0292722 | A1 | 10/2017 | Vandermeulen |
| 2018/0051897 | A1 | 2/2018 | Vandermeulen et al. |
| 2018/0163977 | A1 | 6/2018 | Vandermeulen |

FOREIGN PATENT DOCUMENTS

| | | | |
|---|---|---|---|
| CN | 100476308 | C | 4/2009 |
| CN | 101636630 | A | 1/2010 |
| CN | 102282426 | A | 12/2011 |
| CN | 202229469 | U | 5/2012 |
| EP | 0781972 | A2 | 7/1997 |
| EP | 1120609 | A1 | 8/2001 |
| EP | 1563229 | A1 | 8/2005 |
| EP | 1781995 | A1 | 5/2007 |
| EP | 2256434 | A2 | 12/2010 |
| EP | 2306100 | A1 | 4/2011 |
| EP | 2787293 | A1 | 10/2014 |
| GB | 1172247 | A | 11/1969 |
| JP | S54-77443 | A | 6/1979 |
| JP | S62-297647 | A | 12/1987 |
| JP | 02306067 | A | 12/1990 |
| JP | H03-125830 | A | 5/1991 |
| JP | H03-213921 | A | 9/1991 |
| JP | H08-105669 | A | 4/1996 |
| JP | H09-184692 | A | 7/1997 |
| JP | H10-220914 | A | 8/1998 |
| JP | H11-137948 | A | 5/1999 |
| JP | H11-197439 | A | 7/1999 |
| JP | H11-351700 | A | 12/1999 |
| JP | 2000-230730 | A | 8/2000 |
| JP | 2001-517773 | A | 10/2001 |
| JP | 2002-206834 | A | 7/2002 |
| JP | 2004-524504 | A | 8/2004 |
| JP | 2005-134060 | A | 5/2005 |
| JP | 2006-263508 | A | 10/2006 |
| JP | 2006-529022 | A | 12/2006 |
| JP | 2008-020138 | A | 1/2008 |
| JP | 2009-517622 | A | 4/2009 |
| JP | 04273555 | B2 | 6/2009 |
| JP | 2009-180433 | A | 8/2009 |
| JP | 2009-192101 | A | 8/2009 |
| JP | 2009-281668 | A | 12/2009 |
| JP | 2009-293831 | A | 12/2009 |
| JP | 201054136 | A | 3/2010 |
| JP | 2010-247022 | A | 11/2010 |
| JP | 2011064359 | A | 3/2011 |
| JP | 2011-511244 | A | 4/2011 |
| JP | 201192815 | A | 5/2011 |
| JP | 2011-163682 | A | 8/2011 |
| JP | 2012-073013 | A | 4/2012 |
| JP | 2013-064549 | A | 4/2013 |
| KR | 10-2001-0017939 | A | 3/2001 |
| KR | 2004-0026242 | A | 3/2004 |
| KR | 10-0510774 | B1 | 8/2005 |
| KR | 2014-0022785 | A | 2/2014 |
| TW | 201009269 | A | 3/2010 |
| WO | WO-1997021061 | A1 | 6/1997 |
| WO | WO-1999022180 | A1 | 5/1999 |
| WO | WO-2000011426 | A1 | 3/2000 |
| WO | WO-2000055546 | A1 | 9/2000 |
| WO | WO-2002066901 | A1 | 8/2002 |
| WO | WO-2002086391 | A1 | 10/2002 |
| WO | WO-2003004937 | A1 | 1/2003 |
| WO | WO-2004046618 | A1 | 6/2004 |
| WO | WO-2006006177 | A1 | 1/2006 |
| WO | WO-2008037079 | A1 | 4/2008 |
| WO | WO-2009094032 | A1 | 7/2009 |
| WO | WO-2009144880 | A1 | 12/2009 |
| WO | WO-2009157277 | A1 | 12/2009 |
| WO | WO-2011062808 | A1 | 5/2011 |
| WO | WO-2011150081 | A2 | 12/2011 |
| WO | WO-2011161547 | A2 | 12/2011 |
| WO | WO-2012071036 | A1 | 5/2012 |
| WO | WO-2012082093 | A1 | 6/2012 |
| WO | WO-2013172789 | A1 | 11/2013 |
| WO | WO-2014152905 | A1 | 9/2014 |
| WO | WO-2014201281 | A1 | 12/2014 |
| WO | WO-2015077364 | A1 | 5/2015 |

OTHER PUBLICATIONS

Refrigerant—Random House Kernerman Webster's College Dictionary, "Refrigerant," Random House, <https://thefreedictionary.com/refrigerant> (2010).

1—Open Absorption System for Cooling and Air Conditioning using Membrane Contactors—Annual Report 2005, Publication No. Publication 260097, Project: 101310—Open Absorption System for Cooling and Air Conditioning using Membrane Contactors, Date of publication: Jan. 31, 2006, Author: Manuel Conde-Petit, Robert Weber, Contractor: M. Conde Engineering.

3—Open Absorption System for Cooling and Air Conditioning Using Membrane Contactors—Final Report, Publication No. Publication 280139, Project: 101310—Open Absorption System for Cooling and Air Conditioning using Membrane Contactors, Date of publication: Jul. 8, 2008, Author: Viktor Dorer, Manuel Conde-Petit, Robert Weber, Contractor: M. Conde Engineering.

2—Open Absorption System for Cooling and Air Conditioning using Membrane Contactors—Annual, Report 2006, Publication No. Publication 260098, Project: 101310—Open Absorption System for Cooling and Air Conditioning using Membrane Contactors, Date of publication: Nov. 14, 2006, Author: Manuel Conde-Petit, Robert Weber, Contractor: M. Conde Engineering.

4—Conde-Petit, M. 2007. Liquid Desiccant-Based Air-Conditioning Systems—LDACS, Proc. of the 1st European Conference on Polygeneration—Technologies and Applications, 217-234, A. Coronas, ed., Tarragona-Spain, Oct. 16-17, Published by CREVER—Universitat Rovira I Virgili, Tarragona, Spain.

5—Conde-Petit, M. 2008. Open Absorption Systems for Air-Conditioning using Membrane Contactors,Proceedings '15. Schweizerisches Status-Seminar «Energie- and Umweltforschung im Bauwesen»', Sep. 11-12—ETH Zurich, Switzerland. Published by BRENET—Eggwilstr. 16a, CH-9552 Bronschhofen—Switzerland (brenet@vogel-tech.ch).

6—Third Party Observations for PCT/US2011/037936, dated Sep. 24, 2012.

Ashrae, et al., "Desiccant Dehumidification and Pressue Drying Equipment," 2012 ASHRAE Handbook—HVAC Systems and Equipment, Chapter 24, pp. 24.1-24.12.

Beccali, et al., "Energy and Economic Assessment of Desiccant Cooling," Solar Energy, Issue 83, pp. 1828-1846, Aug. 2009.

Fimbres-Weihs, et al., "Review of 3D CFD modeling of flow and mass transfer in narrow spacer-filled channels in membrane modules," Chemical Engineering and Processing 49 (2010) pp. 759-781.

Li, F., et al., "Novel spacers for mass transfer enhancement in membrane separations," Journal of Membrane Science, 253 (2005), pp. 1-12.

Li, Y., et al., "CFD simulation of fluid flow through spacer-filled membrane module: selecting suitable cell types for periodic boundary conditions," Desalination 233 (2008) pp. 351-358.

Liu, et al., "Research Progress in Liquid Desiccant Air Conditioning Devices and Systems," Frontiers of Energy and Power Engineering in China, vol. 4, Issue 1, pp. 55-65, Feb. 2010.

Lowenstein, "A Solar Liquid-Desiccant Air Conditioner," Solar 2003, Proceedings of the 32nd ASES Annual Conference, Austin, TX, Jul. 2003.

Mathioulakis, "Desalination by Using Alternative Energy," Desalination, Issue 203, pp. 346-365, 2007.

Russell, et al., "Optimization of Photovolatic Thermal Collector Heat Pump Systems," ISES International Solar Energy Conference, Atlanta, GA, vol. 3, pp. 1870-1874, May 1979.

Perry "Perry's Chemical Engineers handbook" 1999 McGraw Hill p. 11-52,11-53.

"Siphon." Encyclopedia Americana. Grolier Online, 2015. Web. Apr. 3, 2015. 1 page.

(56) References Cited

OTHER PUBLICATIONS

Welty, "Liquid Desiccant Dehumidification," Engineered Systems, May 2010, vol. 27 Issue 5, p. 34.
International Search Report and Written Opinion for PCT/US2014/028184, dated Aug. 6, 2014.
European Search Report for EP14769878.1, dated Nov. 24, 2016.
Chinese Patent Application 201480014508.5, Office Action dated Aug. 26, 2016.
Korean Patent Application 10-2015-7025386, Office Action dated Feb. 22, 2017.
Korean Patent Application 10-2015-7025386, Office Action dated Aug. 22, 2017.

* cited by examiner

Cooling Mode

Heating Mode

METHODS AND SYSTEMS FOR MINI-SPLIT LIQUID DESICCANT AIR CONDITIONING

CROSS REFERENCE TO RELATED APPLICATIONS

This application is a divisional of U.S. patent application Ser. No. 14/212,097 filed on Mar. 14, 2014 entitled METHODS AND SYSTEMS FOR MINI-SPLIT LIQUID DESICCANT AIR CONDITIONING, which claims priority from U.S. Provisional Patent Application No. 61/783,176 filed on Mar. 14, 2013 entitled METHODS AND SYSTEMS FOR MINI-SPLIT LIQUID DESICCANT AIR CONDITIONING, both of which applications are hereby incorporated by reference.

BACKGROUND

The present application relates generally to the use of liquid desiccants to dehumidify and cool, or heat and humidify an air stream entering a space. More specifically, the application relates to the replacement of conventional mini-split air conditioning units with (membrane based) liquid desiccant air conditioning system to accomplish the same heating and cooling capabilities as those conventional mini-split air conditioners.

Desiccant dehumidification systems—both liquid and solid desiccants—have been used parallel to conventional vapor compression HVAC equipment to help reduce humidity in spaces, particularly in spaces that require large amounts of outdoor air or that have large humidity loads inside the building space itself. (ASHRAE 2012 Handbook of HVAC Systems and Equipment, Chapter 24, p. 24. 10). Humid climates, such as for example Miami, Fla. require a lot of energy to properly treat (dehumidify and cool) the fresh air that is required for a space's occupant comfort. Desiccant dehumidification systems—both solid and liquid—have been used for many years and are generally quite efficient at removing moisture from the air stream. However, liquid desiccant systems generally use concentrated salt solutions such as ionic solutions of LiCl, LiBr or $CaCl_2$ and water. Such brines are strongly corrosive, even in small quantities, so numerous attempts have been made over the years to prevent desiccant carry-over to the air stream that is to be treated. In recent years efforts have begun to eliminate the risk of desiccant carry-over by employing micro-porous membranes to contain the desiccant. These membrane based liquid desiccant systems have been primarily applied to unitary rooftop units for commercial buildings. However, residential and small commercial buildings often use mini-split air conditioners wherein the condenser is located outside and the evaporator cooling coil is installed in the room or space than needs to be cooled, and unitary rooftop units are not an appropriate choice for servicing those spaces.

Liquid desiccant systems generally have two separate functions. The conditioning side of the system provides conditioning of air to the required conditions, which are typically set using thermostats or humidistats. The regeneration side of the system provides a reconditioning function of the liquid desiccant so that it can be re-used on the conditioning side. Liquid desiccant is typically pumped between the two sides, and a control system helps to ensure that the liquid desiccant is properly balanced between the two sides as conditions necessitate and that excess heat and moisture are properly dealt with without leading to over-concentrating or under-concentrating the desiccant.

In many smaller buildings a small evaporator coil is hung high up on a wall or covered by a painting as for example the LG LAN126HNP Art Cool Picture frame. A condenser is installed outside and high pressure refrigerant lines connect the two components. Furthermore a drain line for condensate is installed to remove moisture that is condensed on the evaporator coil to the outside. A liquid desiccant system can significantly reduce electricity consumption and can be easier to install without the need for high pressure refrigerant lines that need to be installed on site.

Mini-split systems typically take 100% room air through the evaporator coil and fresh air only reaches the room through ventilation and infiltration from other sources. This often can result in high humidity and cool temperatures in the space since the evaporator coil is not very efficient for removing moisture. Rather, the evaporator coil is better suited for sensible cooling. On days where only a small amount of cooling is required the building can reach unacceptable levels of humidity since not enough natural heat is available to balance the large amount of sensible cooling.

There thus remains a need to provide a retrofitable cooling system for small buildings with high humidity loads, wherein the cooling and dehumidification of indoor air can be accommodated at low capital and energy costs.

BRIEF SUMMARY

Provided herein are methods and systems used for the efficient cooling and dehumidification of an air stream especially in small commercial or residential buildings using a mini-split liquid desiccant air conditioning system. In accordance with one or more embodiments, the liquid desiccant flows down the face of a support plate as a falling film. In accordance with one or more embodiments, the desiccant is contained by a microporous membrane and the air stream is directed in a primarily vertical orientation over the surface of the membrane and whereby both latent and sensible heat are absorbed from the air stream into the liquid desiccant. In accordance with one or more embodiments, the support plate is filled with a heat transfer fluid that ideally is flowing in a direction counter to the air stream. In accordance with one or more embodiments, the system comprises a conditioner that removes latent and sensible heat through the liquid desiccant into the heat transfer fluid and a regenerator that rejects the latent and sensible heat from the heat transfer fluid to the environment. In accordance with one or more embodiments, the heat transfer fluid in the conditioner is cooled by a refrigerant compressor or an external source of cold heat transfer fluid. In accordance with one or more embodiments, the regenerator is heated by a refrigerant compressor or an external source of hot heat transfer fluid. In accordance with one or more embodiments, the refrigerant compressor is reversible to provide heated heat transfer fluid to the conditioner and cold heat transfer fluid to the regenerator and the conditioned air is heat and humidified and the regenerated air is cooled and dehumidified. In accordance with one or more embodiments, the conditioner is mounted against a wall in a space and the regenerator is mounted outside of the building. In accordance with one or more embodiments, the regenerator supplies liquid desiccant to the conditioner through a heat exchanger. In one or more embodiments, the heat exchanger comprises two desiccant lines that are bonded together to provide a thermal contact. In one or more embodiments, the conditioner receives 100% room air. In one or more embodiments, the regenerator receives 100% outside air. In one or more embodiments, the conditioner and evaporator are mounted behind a flat screen TV or flat screen monitor or some similar device.

In accordance with one or more embodiments a liquid desiccant membrane system employs an indirect evaporator to generate a cold heat transfer fluid wherein the cold heat transfer fluid is used to cool a liquid desiccant conditioner. Furthermore in one or more embodiments, the indirect evaporator receives a portion of the air stream that was earlier treated by the conditioner. In accordance with one or more embodiments, the air stream between the conditioner and indirect evaporator is adjustable through some convenient means, e.g., through a set of adjustable louvers or through a fan with adjustable fan speed. In one or more embodiments, the water supplied to the indirect evaporator is potable water. In one or more embodiments, the water is seawater. In one or more embodiments, the water is waste water. In one or more embodiments, the indirect evaporator uses a membrane to prevent carry-over of non-desirable elements from the seawater or waste water. In one or more embodiments, the water in the indirect evaporator is not cycled back to the top of the indirect evaporator such as would happen in a cooling tower, but between 20% and 80% of the water is evaporated and the remainder is discarded. In one or more embodiments, the indirect evaporator is mounted directly behind or directly next to the conditioner. In one or more embodiments, the conditioner and evaporator are mounted behind a flat screen TV or flat screen monitor or some similar device. In one or more embodiments, the exhaust air from the indirect evaporator is exhausted out of the building space. In one or more embodiments, the liquid desiccant is pumped to a regenerator mounted outside the space through a heat exchanger. In one or more embodiments, the heat exchanger comprises two lines that are thermally bonded together to provide a heat exchange function. In one or more embodiments, the regenerator receives heat from a heat source. In one or more embodiments, the heat source is a solar heat source. In one or more embodiments, the heat source is a gas-fired water heater. In one or more embodiments, the heat source is a steam pipe. In one or more embodiments, the heat source is waste heat from an industrial process or some other convenient heat source. In one or more embodiments, the heat source can be switched to provide heat to the conditioner for winter heating operation. In one or more embodiments, the heat source also provides heat to the indirect evaporator. In one or more embodiments, the indirect evaporator can be directed to provide humid warm air to the space rather than exhausting the air to the outside.

In accordance with one or more embodiments, the indirect evaporator is used to provide heated, humidified air to a supply air stream to a space while a conditioner is simultaneously used to provide heated, humidified air to the same space. This allows the system to provide heated, humidified air to a space in winter conditions. The conditioner is heated and is desorbing water vapor from a desiccant and the indirect evaporator can be heated as well and is desorbing water vapor from liquid water. In combination the indirect evaporator and conditioner provide heated humidified air to the building space for winter heating conditions.

In no way is the description of the applications intended to limit the disclosure to these applications. Many construction variations can be envisioned to combine the various elements mentioned above each with its own advantages and disadvantages. The present disclosure in no way is limited to a particular set or combination of such elements.

DETAILED DESCRIPTION

Figure 1:
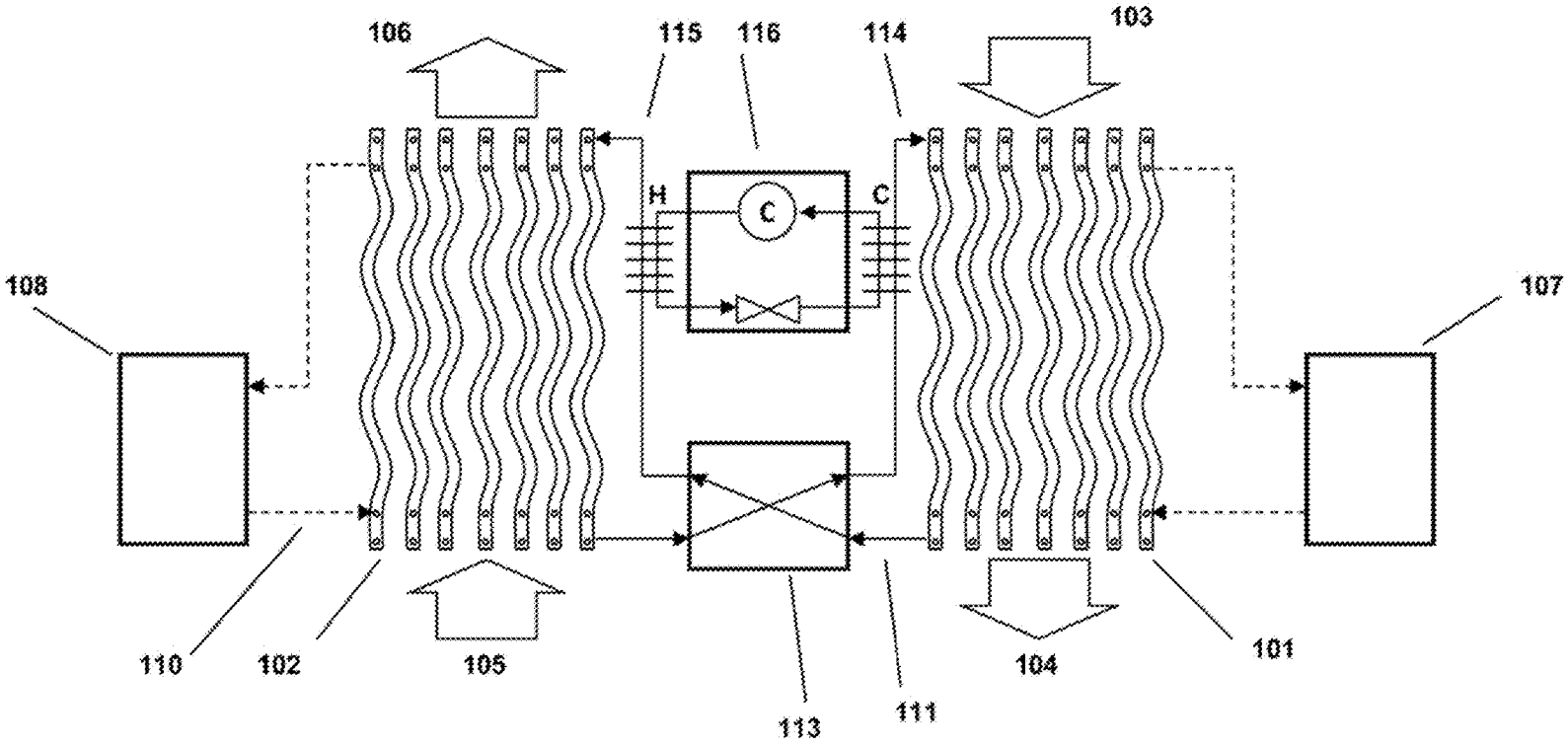
FIG. 1 illustrates an exemplary 3-way liquid desiccant air conditioning system using a chiller or external heating or cooling sources.

FIG. 1 depicts a new type of liquid desiccant system as described in more detail in U.S. Patent Application Publication No. US 20120125020, which is incorporated by reference herein. A conditioner 101 comprises a set of plate structures that are internally hollow. A cold heat transfer fluid is generated in cold source 107 and entered into the plates. Liquid desiccant solution at 114 is brought onto the outer surface of the plates and runs down the outer surface of each of the plates. The liquid desiccant runs behind a thin membrane that is located between the air flow and the surface of the plates. Outside air 103 is now blown through the set of wavy plates. The liquid desiccant on the surface of the plates attracts the water vapor in the air flow and the cooling water inside the plates helps to inhibit the air temperature from rising. The treated air 104 is put into a building space.

The liquid desiccant is collected at the bottom of the wavy plates at 111 and is transported through a heat exchanger 113 to the top of the regenerator 102 to point 115 where the liquid desiccant is distributed across the wavy plates of the regenerator. Return air or optionally outside air 105 is blown across the regenerator plate and water vapor is transported from the liquid desiccant into the leaving air stream 106. An optional heat source 108 provides the driving force for the regeneration. The hot transfer fluid 110 from the heat source can be put inside the wavy plates of the regenerator similar to the cold heat transfer fluid on the conditioner. Again, the liquid desiccant is collected at the bottom of the wavy plates 102 without the need for either a collection pan or bath so that also on the regenerator the air flow can be horizontal or vertical. An optional heat pump 116 can be used to provide cooling and heating of the liquid desiccant. It is also possible to connect a heat pump between the cold source 107 and the hot source 108, which is thus pumping heat from the cooling fluids rather than the desiccant.

Figure 2:
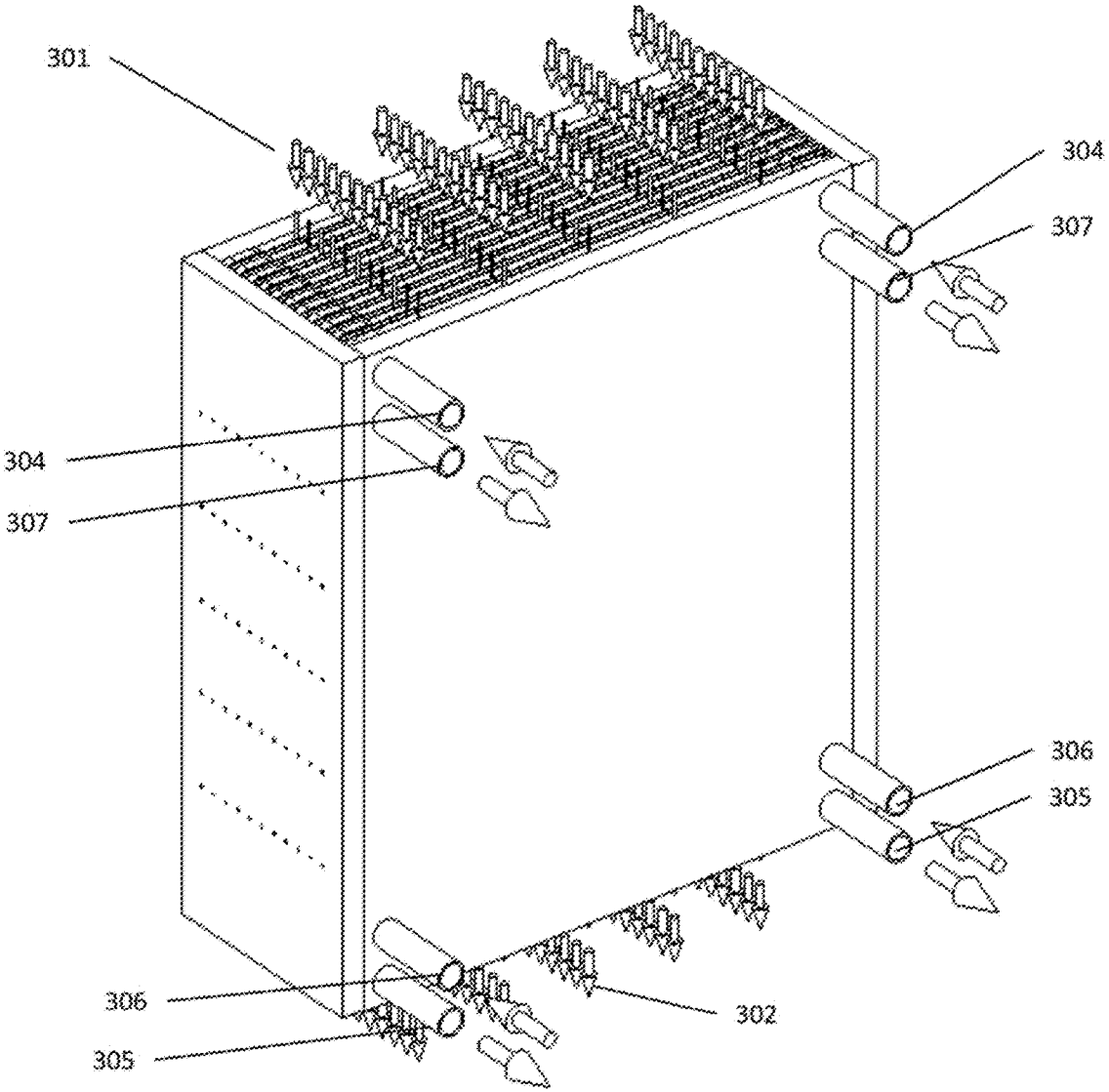
FIG. 2 shows an exemplary flexibly configurable membrane module that incorporates 3-way liquid desiccant plates.

FIG. 2 describes a 3-way heat exchanger as described in further detail in U.S. patent application Ser. No. 13/915,199 filed on Jun. 11, 2013, Ser. No. 13/915,222 filed on Jun. 11, 2013, and Ser. No. 13/915,262 filed on Jun. 11, 2013, which are all incorporated by reference herein. A liquid desiccant enters the structure through ports 304 and is directed behind a series of membranes as described in FIG. 1. The liquid desiccant is collected and removed through ports 305. A cooling or heating fluid is provided through ports 306 and runs counter to the air stream 301 inside the hollow plate structures, again as described in FIG. 1 and in more detail in FIG. 3. The cooling or heating fluids exit through ports 307. The treated air 302 is directed to a space in a building or is exhausted as the case may be.

Figure 3:
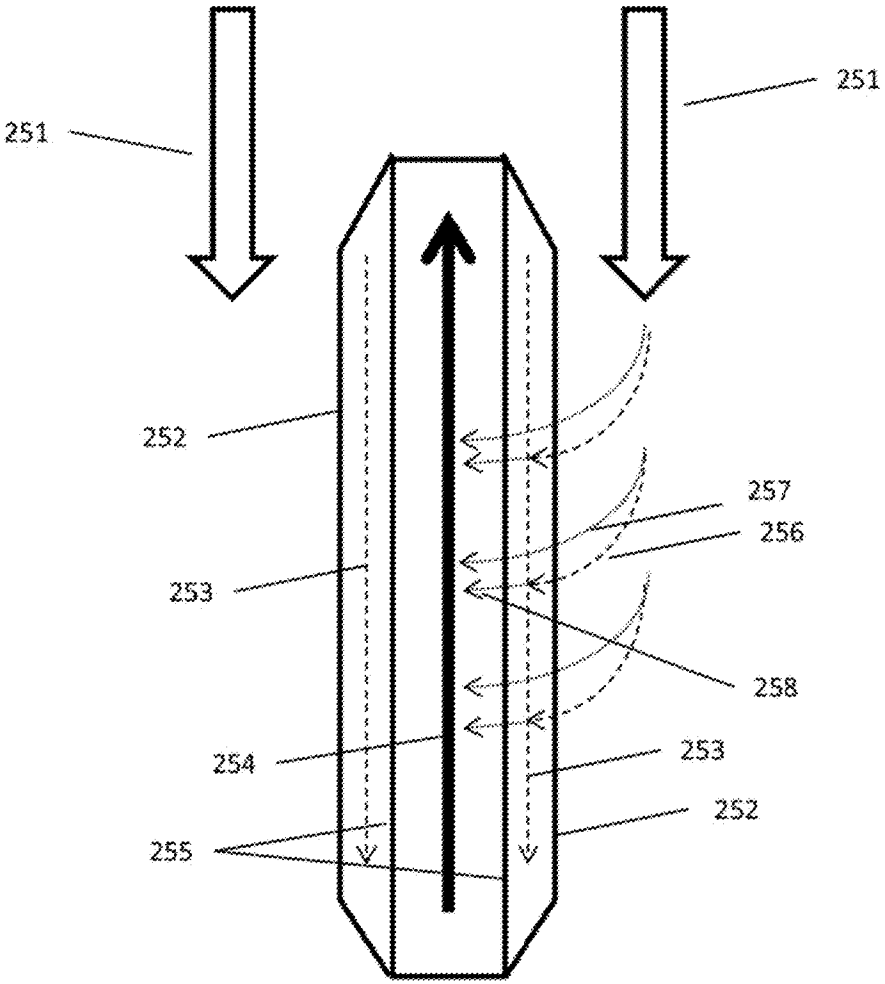
FIG. 3 illustrates an exemplary single membrane plate in the liquid desiccant membrane module of FIG. 2.

FIG. 3 describes a 3-way heat exchanger as described in more detail in U.S. Provisional Patent Applications Ser. No. 61/771,340 filed on Mar. 1, 2013, which is incorporated by reference herein. The air stream 251 flows counter to a cooling fluid stream 254. Membranes 252 contain a liquid desiccant 253 that is falling along the wall 255 that contain a heat transfer fluid 254. Water vapor 256 entrained in the air stream is able to transition the membrane 252 and is absorbed into the liquid desiccant 253. The heat of condensation of water 258 that is released during the absorption is conducted through the wall 255 into the heat transfer fluid 254. Sensible heat 257 from the air stream is also conducted through the membrane 252, liquid desiccant 253 and wall 255 into the heat transfer fluid 254.

Figure 4:
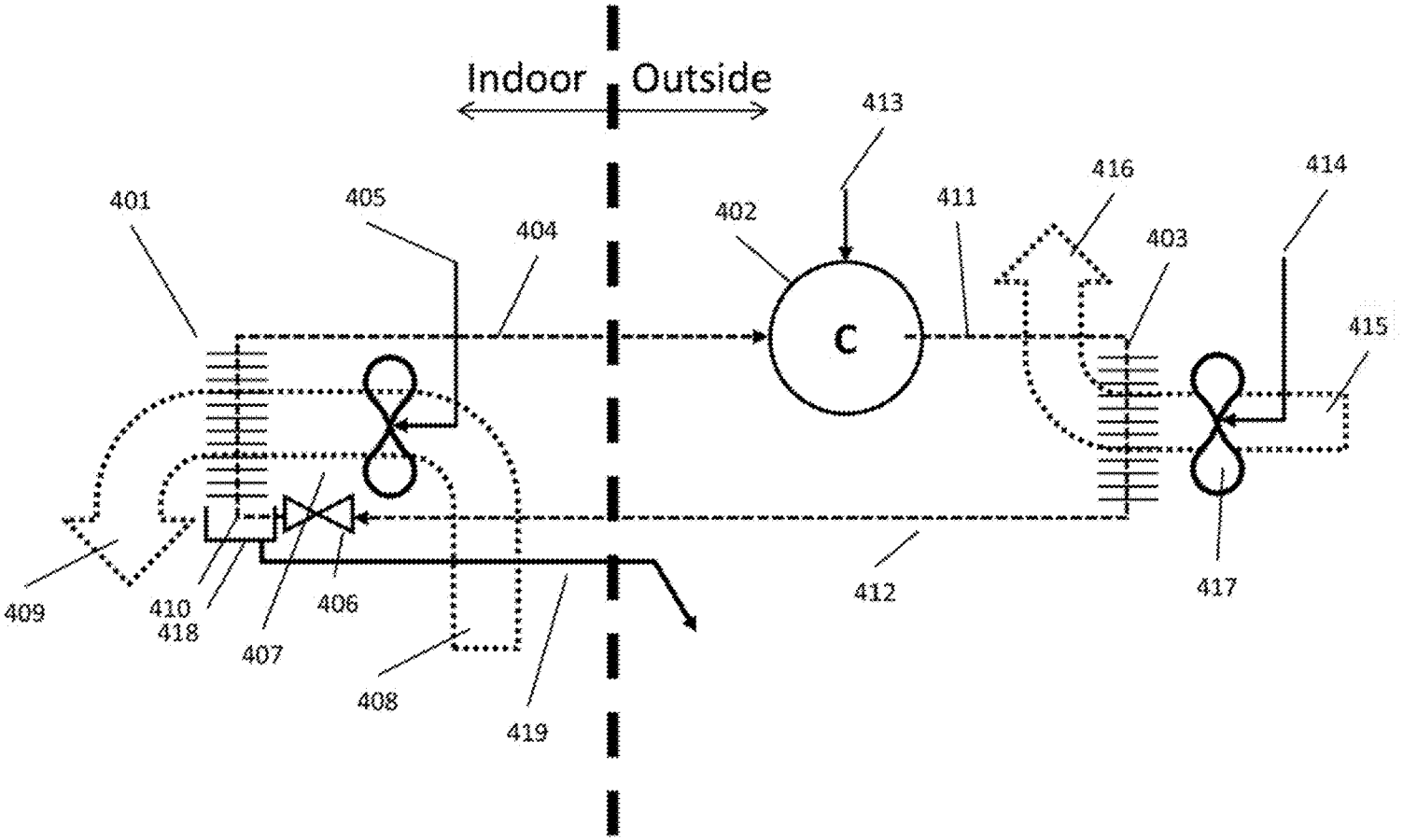
FIG. 4 shows a schematic of a conventional mini-split air conditioning system.

FIG. 4 illustrates a schematic diagram of a conventional mini-split air conditioning system as is frequently installed on buildings. The unit comprises a set of indoor components that generate cool, dehumidified air and a set of outdoor components that release heat to the environment. The indoor components comprise a cooling (evaporator) coil 401 through which a fan 407 blows air 408 from the room. The cooling coil cools the air and condenses water vapor on the coil which is collected in drain pan 418 and ducted to the outside 419. The resulting cooler, drier air 409 is circulated into the space and provides occupant comfort. The cooling coil 401 receives liquid refrigerant at pressures of typically 50-200 psi through line 412, which has already been expanded to a low temperature and pressure by expansion valve 406. The pressure of the refrigerant in line 412 is typically 300-600 psi. The cold liquid refrigerant 410 enters the cooling coil 401 where it picks up heat from the air stream 408. The heat from the air stream evaporates the liquid refrigerant in the coil and the resulting gas is transported through line 404 to the outdoor components and more specifically to the compressor 402 where it is re-compressed to a high pressure of typically 300-600 psi. In some instances the system can have multiple cooling coils 410, fans 407 and expansion valves 406, for example a cooling coil assembly could be located in various rooms that need to be cooled.

Besides the compressor 402, the outdoor components comprise a condenser coil 403 and a condenser fan 417. The fan 417 blows outside air 415 through the condenser coil 403 where it picks up heat from the compressor 402 which is rejected by air stream 416. The compressor 402 creates hot compressed refrigerant in line 411. The heat of compression is rejected in the condenser coil 403. In some instances the system can have multiple compressors or multiple condenser coils and fans. The primary electrical energy consuming components are the compressor through electrical line 413, the condenser fan electrical motor through supply line 414 and the evaporator fan motor through line 405. In general the compressor uses close to 80% of the electricity required to operate the system, with the condenser and evaporator fans taking about 10% of the electricity each.

Figure 5A:
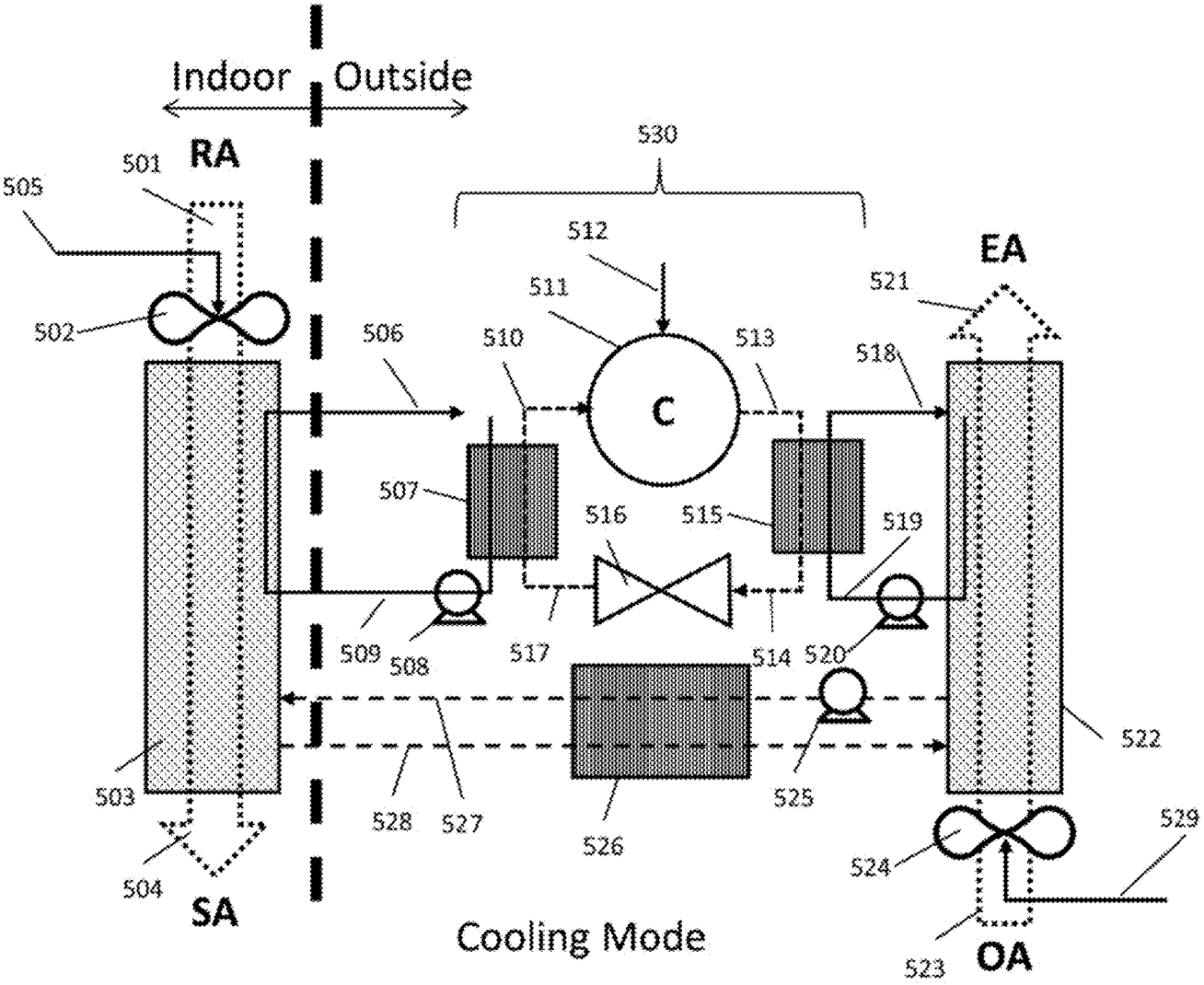
FIG. 5A shows a schematic of an exemplary chiller assisted mini-split liquid desiccant air conditioning system in a summer cooling mode in accordance with one or more embodiments.

FIG. 5A illustrates a schematic representation of a liquid desiccant air conditioner system. A 3-way conditioner 503 (which is similar to the conditioner 101 of FIG. 1) receives an air stream 501 from a room ("RA"). Fan 502 moves the air 501 through the conditioner 503 wherein the air is cooled and dehumidified. The resulting cool, dry air 504 ("SA") is supplied to the room for occupant comfort. The 3-way conditioner 503 receives a concentrated desiccant 527 in the manner explained under FIGS. 1-3. It is preferable to use a membrane on the 3-way conditioner 503 to ensure that the desiccant is generally fully contained and is unable to get distributed into the air stream 504. The diluted desiccant 528, which contains the captured water vapor is transported to the outside regenerator 522. Furthermore the chilled water 509 is provided by pump 508, enters the conditioner module 503 where it picks up heat from the air as well as latent heat released by the capture of water vapor in the desiccant 527. The warmer water 506 is also brought outside to the heat exchanger 507 on the chiller system 530. It is worth noting that unlike the mini-split system of FIG. 4, which has high pressure between 50 and 600 psi, the lines between the indoor and outdoor system of FIG. 5A are all low pressure water and liquid desiccant lines. This allows the lines to be inexpensive plastics rather than refrigerant lines in FIG. 4, which are typically copper and need to be braised in order to withstand the high refrigerant pressures. It is also worth noting that the system of FIG. 5A does not require a condensate drain line like line 419 in FIG. 4. Rather, any moisture that is condensed into the desiccant is removed as part of the desiccant itself. This also eliminates problems with mold growth in standing water that can occur in the conventional mini-split systems of FIG. 4.

The liquid desiccant 528 leaves the conditioner 503 and is moved through the optional heat exchanger 526 to the regenerator 522 by pump 525. If the desiccant lines 527 and 528 are relatively long they can be thermally connected to each other, which eliminates the need for heat exchanger 526.

The chiller system 530 comprises a water to refrigerant evaporator heat exchanger 507 which cools the circulating cooling fluid 506. The liquid, cold refrigerant 517 evaporates in the heat exchanger 507 thereby absorbing the thermal energy from the cooling fluid 506. The gaseous refrigerant 510 is now re-compressed by compressor 511. The compressor 511 ejects hot refrigerant gas 513, which is liquefied in the condenser heat exchanger 515. The liquid refrigerant 514 then enters expansion valve 516, where it rapidly cools and exits at a lower pressure. It is worth noting that the chiller system 530 can be made very compact since the high pressure lines with refrigerant (510, 513, 514 and 517) only have to run very short distances. Furthermore, since the entire refrigerant system is located outside of the space that is to be conditioned, it is possible to utilize refrigerants that normally cannot be used in indoor environments such as by way of example, $CO_2$, Ammonia and Propane. These refrigerants are sometimes preferable over the commonly used R410A, R407A, R134A or R1234YF refrigerants, but they are undesirable indoor because of flammability or suffocation or inhaling risks. By keeping all of the refrigerants outside, these risks are essentially eliminated. The condenser heat exchanger 515 now releases heat to another cooling fluid loop 519 which brings hot heat transfer fluid 518 to the regenerator 522. Circulating pump 520 brings the heat transfer fluid back to the condenser 515. The 3-way regenerator 522 thus receives a dilute liquid desiccant 528 and hot heat transfer fluid 518. A fan 524 brings outside air 523 ("OA") through the regenerator 522. The outside air picks up heat and moisture from the heat transfer fluid 518 and desiccant 528 which results in hot humid exhaust air ("EA") 521.

The compressor 511 receives electrical power 512 and typically accounts for 80% of electrical power consumption of the system. The fan 502 and fan 524 also receive electrical power 505 and 529 respectively and account for most of the remaining power consumption. Pumps 508, 520 and 525 have relatively low power consumption. The compressor 511 will operate more efficiently than the compressor 402 in FIG. 4 for several reasons: the evaporator 507 in FIG. 5A will typically operate at higher temperature than the evaporator 401 in FIG. 4 because the liquid desiccant will condense water at much higher temperature without needing to reach saturation levels in the air stream. Furthermore the condenser 515 in FIG. 5A will operate at lower temperatures than the condenser 403 in FIG. 4 because of the evaporation occurring on the regenerator 522 which effectively keeps the condenser 515 cooler. As a result the system of FIG. 5A will use less electricity than the system of FIG. 4 for similar compressor isentropic efficiencies.

Figure 5B:
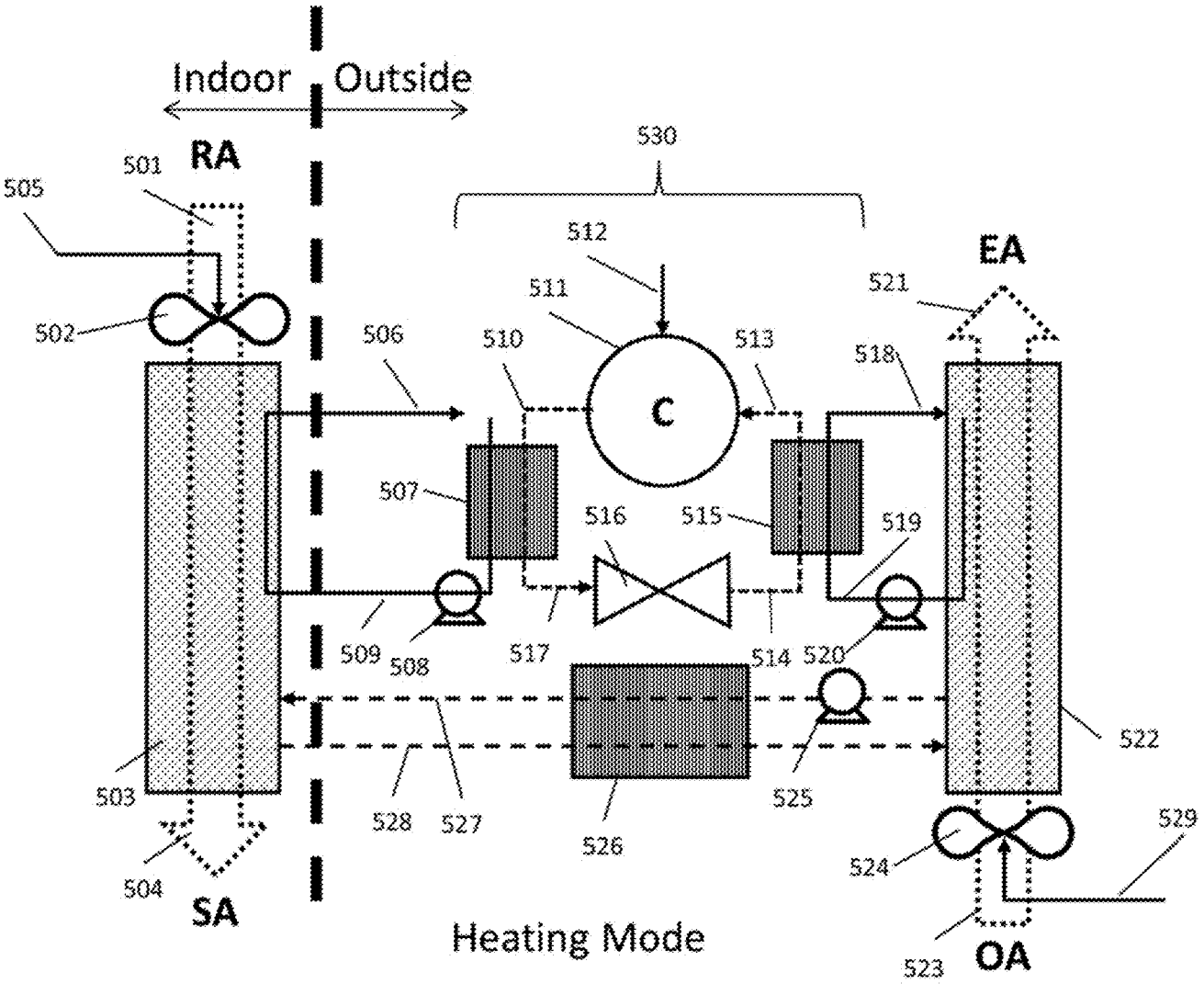
FIG. 5B shows a schematic of an exemplary chiller assisted mini-split liquid desiccant air conditioning system in a winter heating mode in accordance with one or more embodiments.

FIG. 5B shows essentially the same system as FIG. 5A except that the compressor 511's refrigerant direction has been reversed as indicated by the arrows on refrigerant lines 514 and 510. Reversing the direction of refrigerant flow can be achieved by a 4-way reversing valve (not shown) or other convenient means. It is also possible to instead of reversing the refrigerant flow to direct the hot heat transfer fluid 518 to the conditioner 503 and the cold heat transfer fluid 506 to the regenerator 522. This will in effect provide heat to the conditioner which will now create hot, humid air 504 for the space for operation in winter mode. In effect the system is now working as a heat pump, pumping heat from the outside air 523 to the space supply air 504. However unlike the system of FIG. 4, which is oftentimes also reversible, there is much less of a risk of the coil freezing because the desiccant 525 usually has much lower crystallization limit than water vapor. In the system of FIG. 4, the air stream 523 contains water vapor and if the condenser coil 403 gets too cold, this moisture will condense on the surfaces and create ice formation on those surfaces. The same moisture in the regenerator of FIG. 5B will condense in the liquid desiccant which—when managed properly will not crystalize until −60° C. for some desiccants such as LiCl and water.

Figure 6:
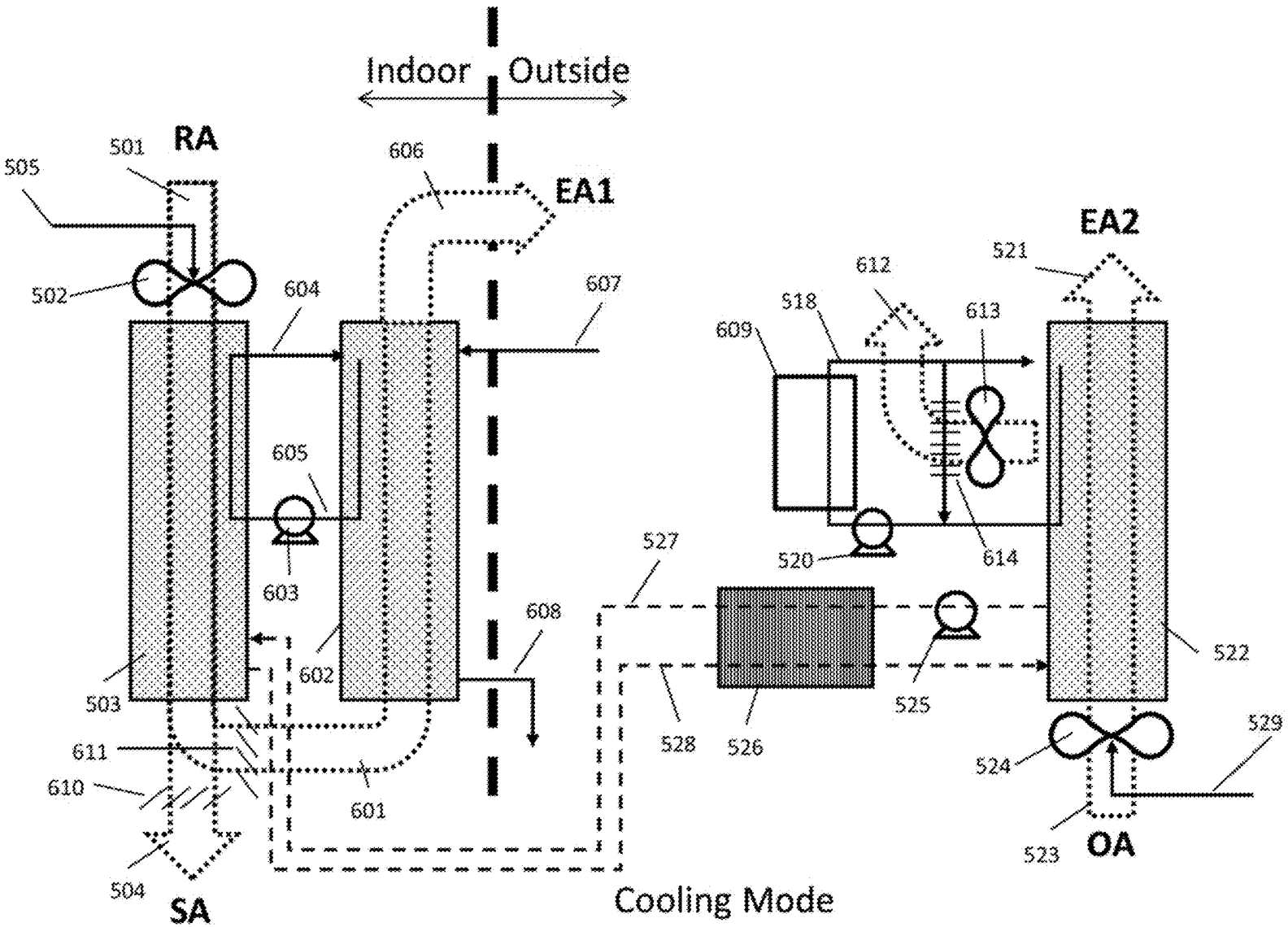
FIG. 6 shows an alternate embodiment of a mini-split liquid desiccant air conditioning system using an indirect evaporative cooler and an external heat source in accordance with one or more embodiments.

FIG. 6 illustrates an alternate embodiment of a mini-split liquid desiccant system. Similar to FIG. 5A, a 3-way liquid desiccant conditioner 503 receives an air stream 501 ("RA") moved by fan 502 through the conditioner 503. However unlike the case of FIG. 5A, a portion 601 of the supply air stream 504 ("SA") is directed towards an indirect evaporative cooling module 602 through sets of louvers 610 and 611. Air stream 601 is usually between 0 and 40% of the flow of air stream 504. The dry air stream 601 is now directed through the 3-way indirect evaporative cooling module 602 which is constructed similarly to the 3-way conditioner module 503, except that instead of using a desiccant behind a membrane, the module now has a water film behind such membrane supplied by water source 607. This water film can be potable water, non-potable water, seawater or waste water or any other convenient water containing substance that is mostly water. The water film evaporates in the dry air stream 601 creating a cooling effect in the heat transfer fluid 604 which is then circulated to the conditioner module as cold heat transfer fluid 605 by pump 603. The cold water 605 then cools the conditioner module 503, which in turn creates cooler drier air 504, which then results in an even stronger cooling effect in the indirect evaporative module 602. As a result the supply air 504 will ultimately be both dry and cold and is supplied to the space for occupant comfort. Conditioner module 503 also receives a concentrated liquid desiccant 527 that absorbs moisture from the air stream 501. Dilute liquid desiccant 528 is then returned to the regenerator 522 similar to FIG. 5A. It is of course possible to locate the indirect evaporative cooler 602 outside of the space rather than inside, but for thermal reasons it is probably better to mount the indirect evaporator 602 in close proximity to the conditioner 503. The indirect evaporative cooling module 602 does not evaporate all of the water (typically 50 to 80%) and thus a drain 608 is employed. The exhaust air stream 606 ("EA1") from the module evaporative cooling module 602 is brought to the outside since it is warm and very humid.

As in FIG. 5A, the concentrated liquid desiccant 527 and dilute liquid desiccant 528 pass through a heat exchanger 526 by pump 525. As before one can thermally connect the lines 527 and 528 which eliminates the need for heat exchanger 526. The 3-way regenerator 522 as before receives an outdoor air stream 523 through fan 524. And as before a hot heat transfer fluid 518 is applied to the 3-way regenerator module 522 by pump 520. However unlike the system of FIG. 5A, there is no heat from a compressor to use in the regenerator 522, so an external heat source 609 needs to be provided. This heat source can be a gas water heater, a solar module, a solar thermal/PV hybrid module (a PVT module), it can be heat from a steam loop or other convenient source of heat or hot water. In order to prevent over-concentration of the desiccant 528, a supplemental heat dump 614 can be employed which can temporarily absorb heat from the heat source 609. An additional fan 613 and air stream 612 are then necessary as well. Of course other forms of heat dumps can be devised and may not always be required. The heat source 609 ensures that the excess water is evaporated from the desiccant 528 so that it can be re-used on the conditioner 503. As a result the exhaust stream 521 ("EA2") comprises hot, humid air. It is worth noting that again no high pressure lines are needed between the indoor and outside components of the system. A single water line for water supply is needed and a drain line for the removal of excess water. However a compressor and heat exchanger are no longer required in this embodiment. As a result this system will use significantly less electricity than the system of FIG. 4 and the system of FIG. 5A. The major consumption of electricity are now the fans 502 and 524 through electrical supply lines 505 and 529 respectively and the liquid pumps 603, 520 and 525. However these devices consume considerably less power than the compressor 402 in FIG. 4.

Figure 7:
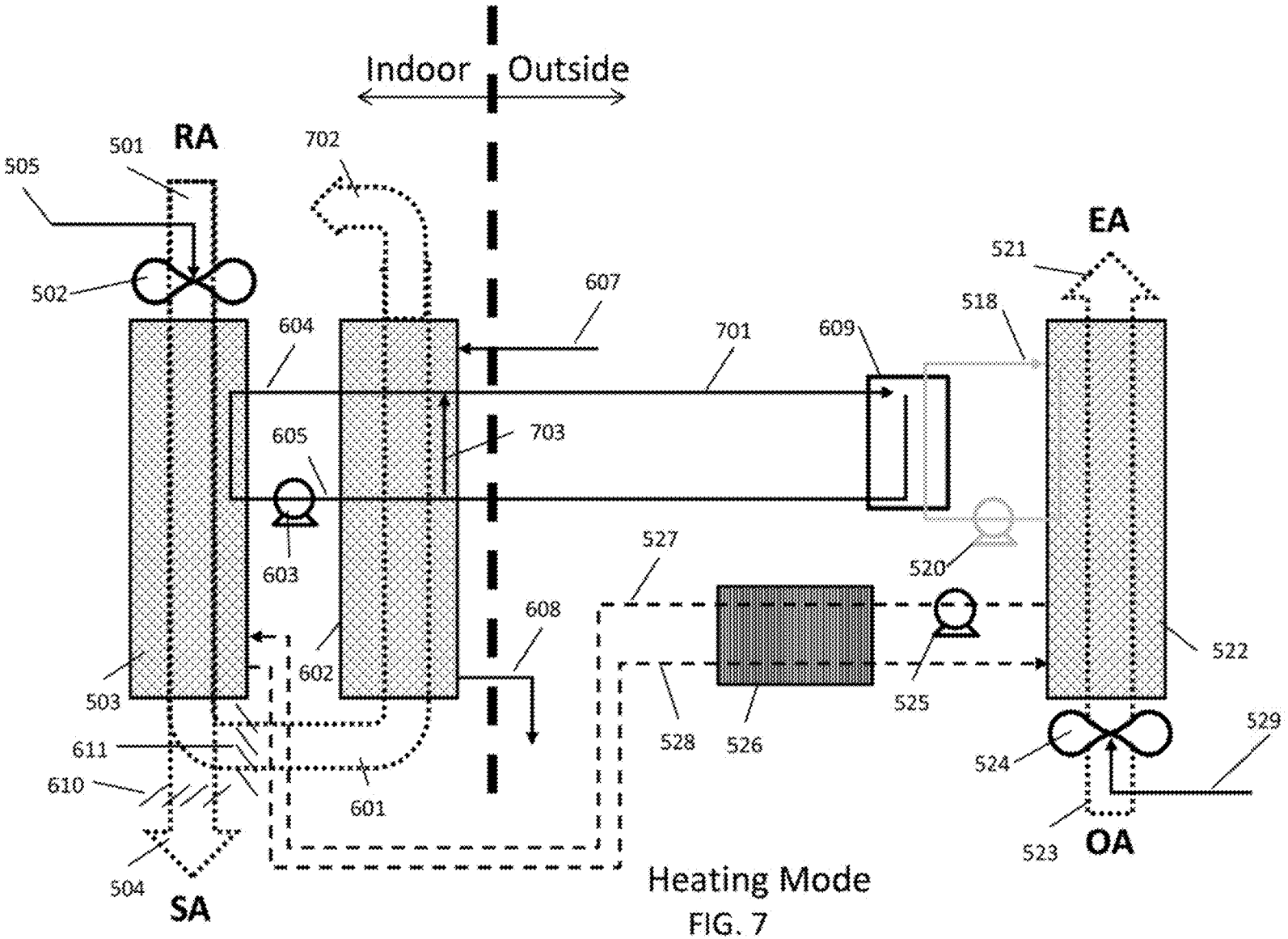
FIG. 7 shows the liquid desiccant mini-split system of FIG. 6 configured for operation in a winter heating mode in accordance with one or more embodiments.

FIG. 7 illustrates the system of FIG. 6 reconfigured slightly to allow for operation in winter heating mode. The heat source 609 now provides hot heat transfer fluid to the conditioner module 503 through lines 701. As a result the supply air to the space 504 will be warm and humid. It is also possible to provide hot heat transfer fluid 703 to the indirect evaporative cooler 602 and to direct the hot, humid exhaust air 702 to the space rather than to the outside. This increases the available heating and humidification capacity of the system since both the conditioner 503 and the indirect evaporative "cooler" 602 (or "heater" may be a better moniker) are operating to provide the same hot humid air and this can be handy since heating capacity in winter typically needs to be larger than cooling capacity in summer.

Figure 8:
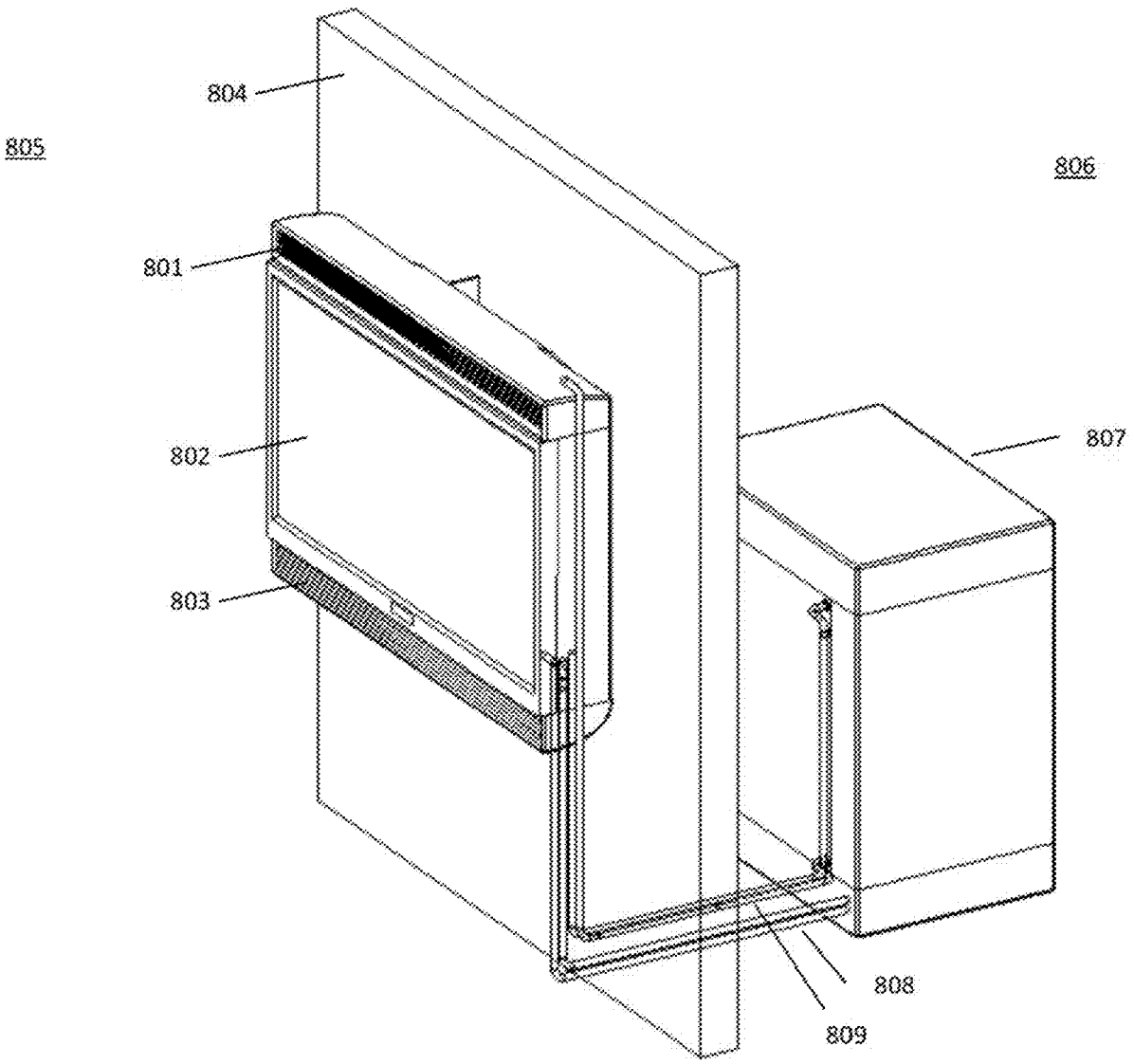
FIG. 8 is a perspective view of an exemplary liquid desiccant mini-split system similar to FIG. 5A.

FIG. 8 shows an embodiment of the system of FIG. 5A. The air intake 801 allows for air from space 805 to enter the conditioner unit 503 (not shown). The air supply exits from roster 803 into the space. A flat screen television 802 or painting, or monitor or any other suitable device can be used to visually hide the conditioner 503. An external wall 804 would be a logical place to mount the conditioner system. A regenerator and chiller system 807 can be mounted in a convenient outside location 806. Desiccant supply and return lines 809 and cold heat transfer fluid supply and return lines 808 connect the two sides of the system.

Figure 9B:
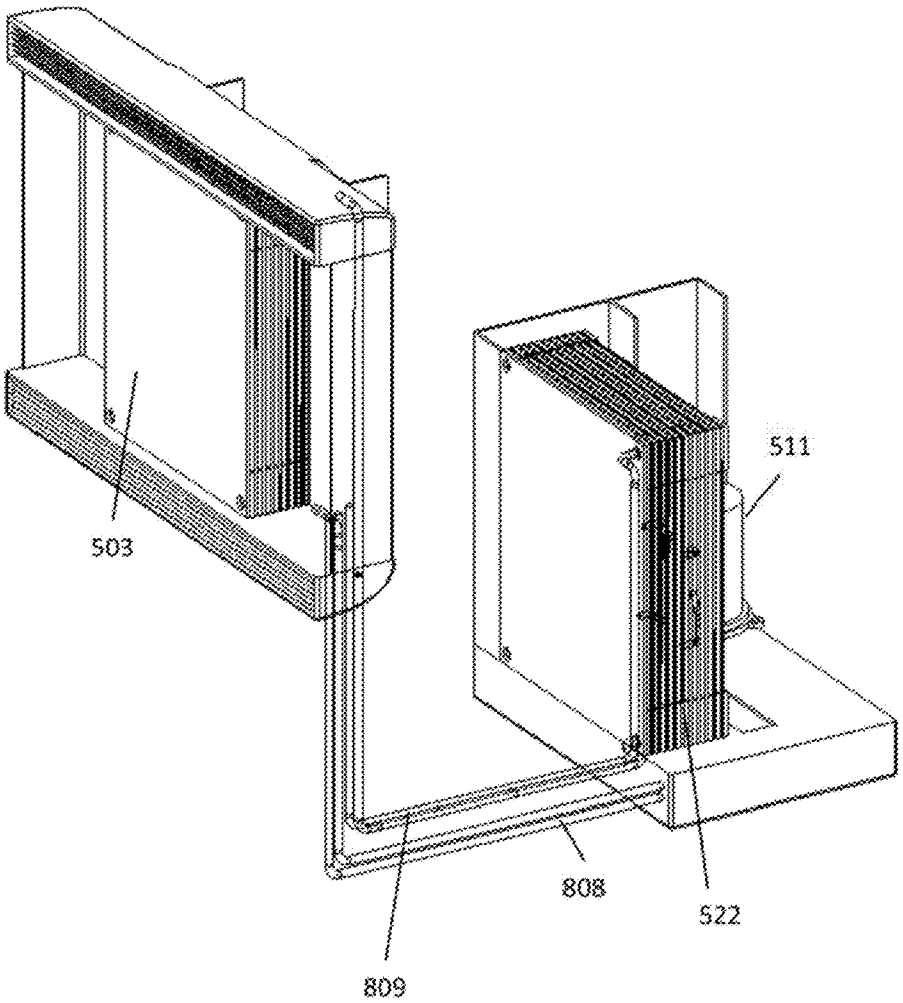
FIG. 9B illustrates a cut-away front-view of the system of FIG. 8.
Figure 9A:
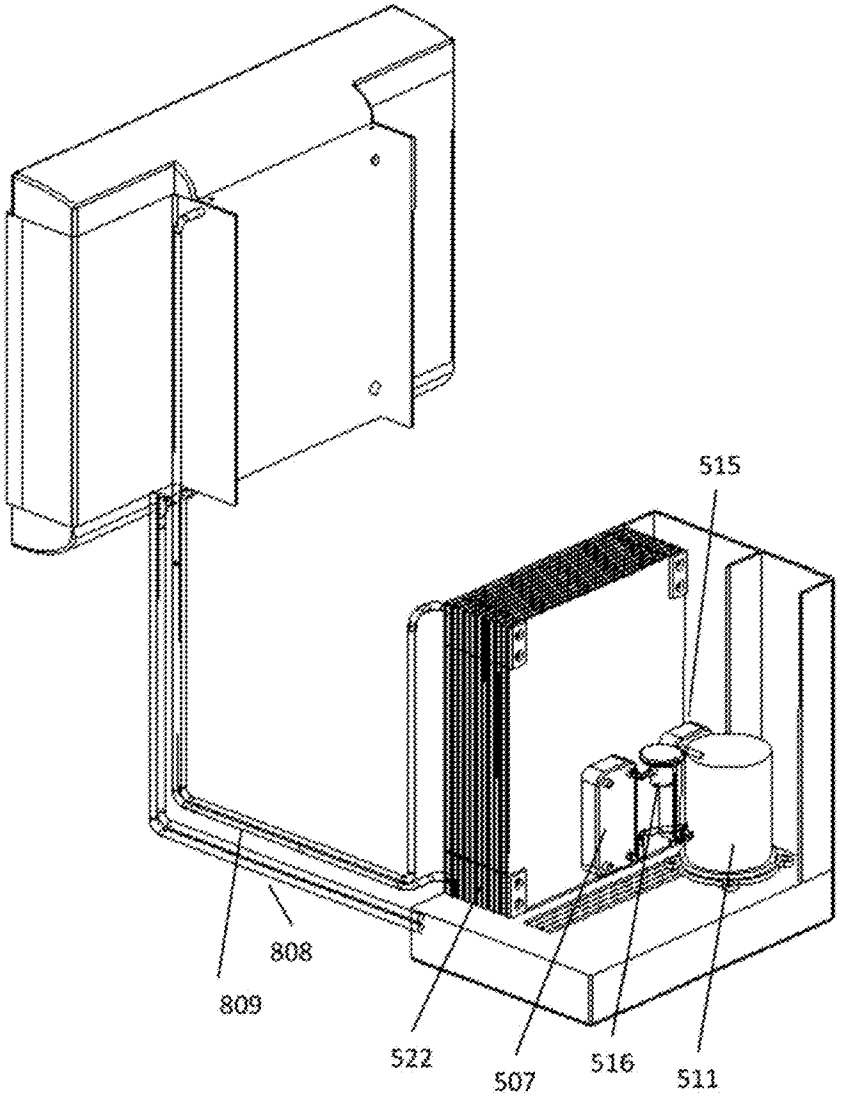
FIG. 9A illustrates a cut-away rear-view of the system of FIG. 8.

FIG. 9A shows a cut-away view of the rear side of the system in FIG. 8. The regenerator module 522 receives liquid desiccant from lines 809. A compressor 511 an expansion valve 516 and two refrigerant to liquid heat exchangers 507 and 515 are also shown. Other components have not been shown for convenience.

FIG. 9B shows a cut-away view of the front side of the system in FIG. 8. The flat screen TV 802 has been omitted to allow a view of the conditioner module 503.

Figure 10:
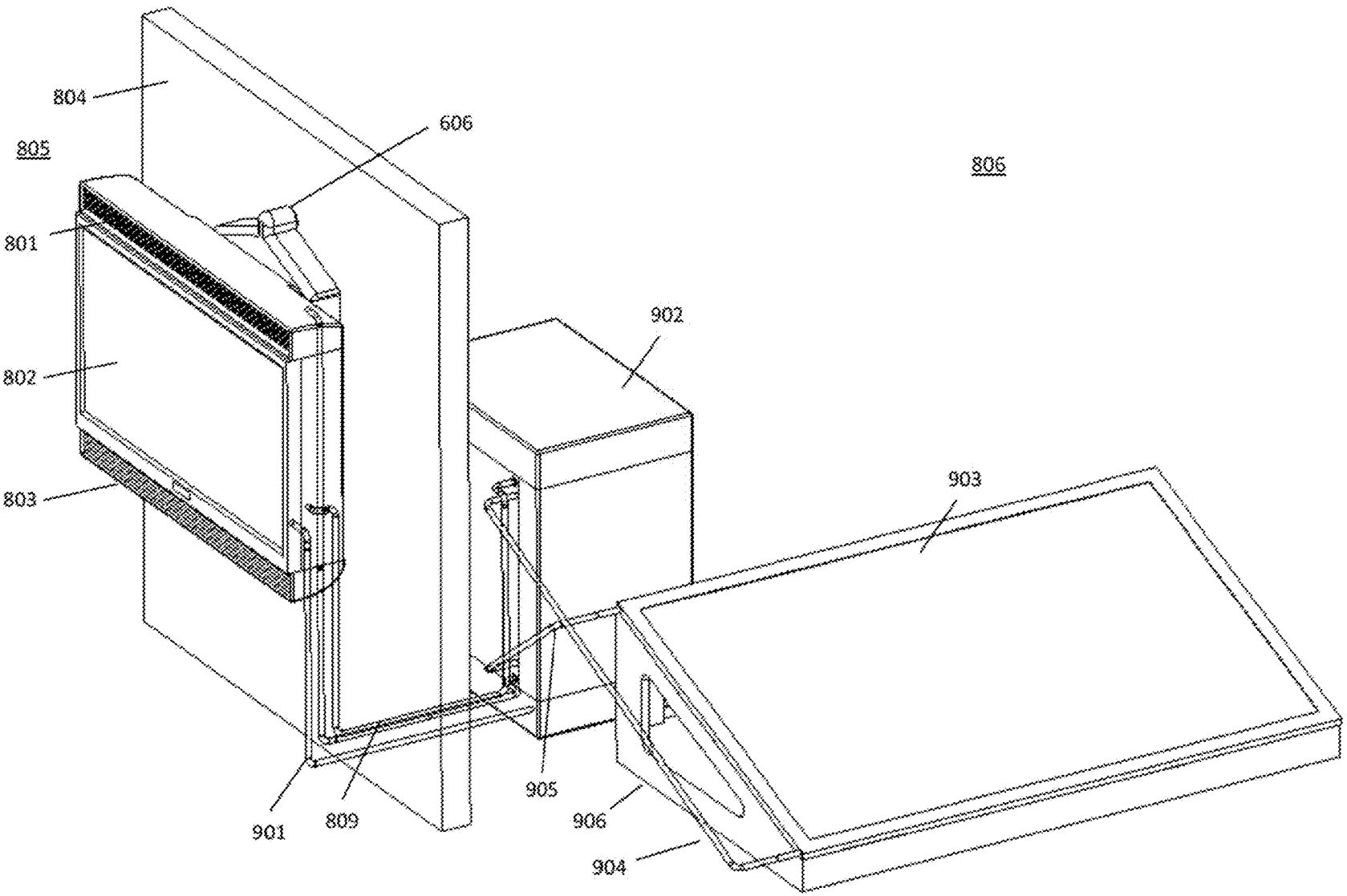
FIG. 10 shows a three dimensional view of a liquid desiccant mini-split system of FIG. 6 in accordance with one or more embodiments.

FIG. 10 shows an aspect of an embodiment of the system of FIG. 6. The system has an air intake 801 and a supply roster 803 similar to the system of FIG. 8. As in FIG. 8, a TV 802 or something similar can be used to cover the conditioner module 503. The unit can be mounted to wall 804 and provide conditioning of the space 805. The system also has an exhaust 606 that penetrates the wall 804. On the outside 806, the regenerator module 902 provides concentrated liquid desiccant to the conditioner section (not shown) through desiccant supply and return lines 809. A water supply line 901 is also shown. A source of hot heat transfer fluid can be the solar PVT module 903 which provides hot water through line 905 which after being cooled through the regenerator returns heat transfer fluid to the PVT module 903 through line 904. An integrated hot water storage tank 906 can provide both a hot water buffer as well as a ballast for the PVT module 903.

Figure 11:
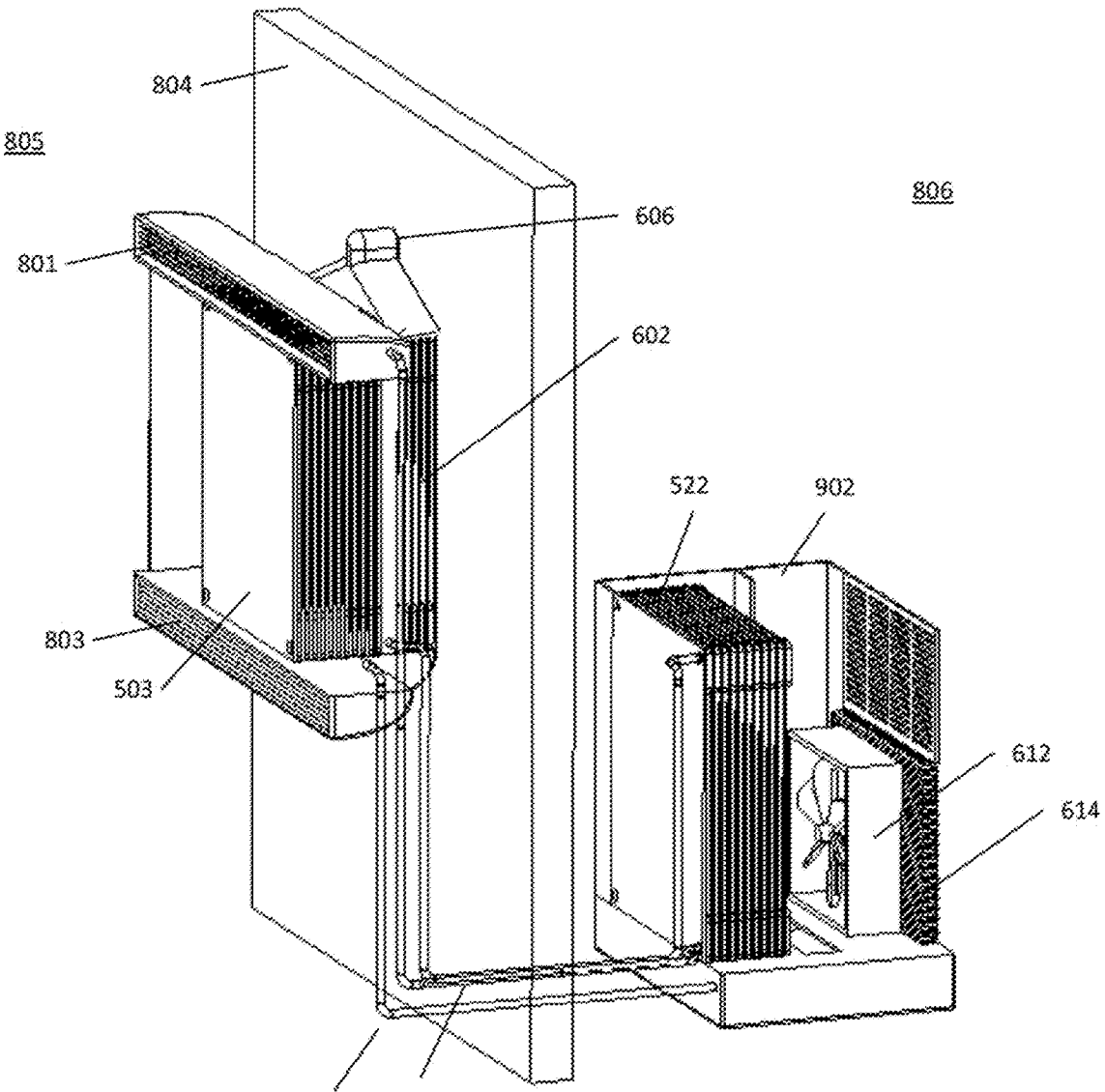
FIG. 11 shows a cut-away view of the system of FIG. 10 in accordance with one or more embodiments.

FIG. 11 shows a cut-away view of the system of FIG. 10. The conditioner module 503 can be clearly seen as can the indirect evaporator module 602. Inside the regenerator module 902 one can see the regenerator module 522 as well as the optional heat dump 614 and fan 612.

Figure 12:
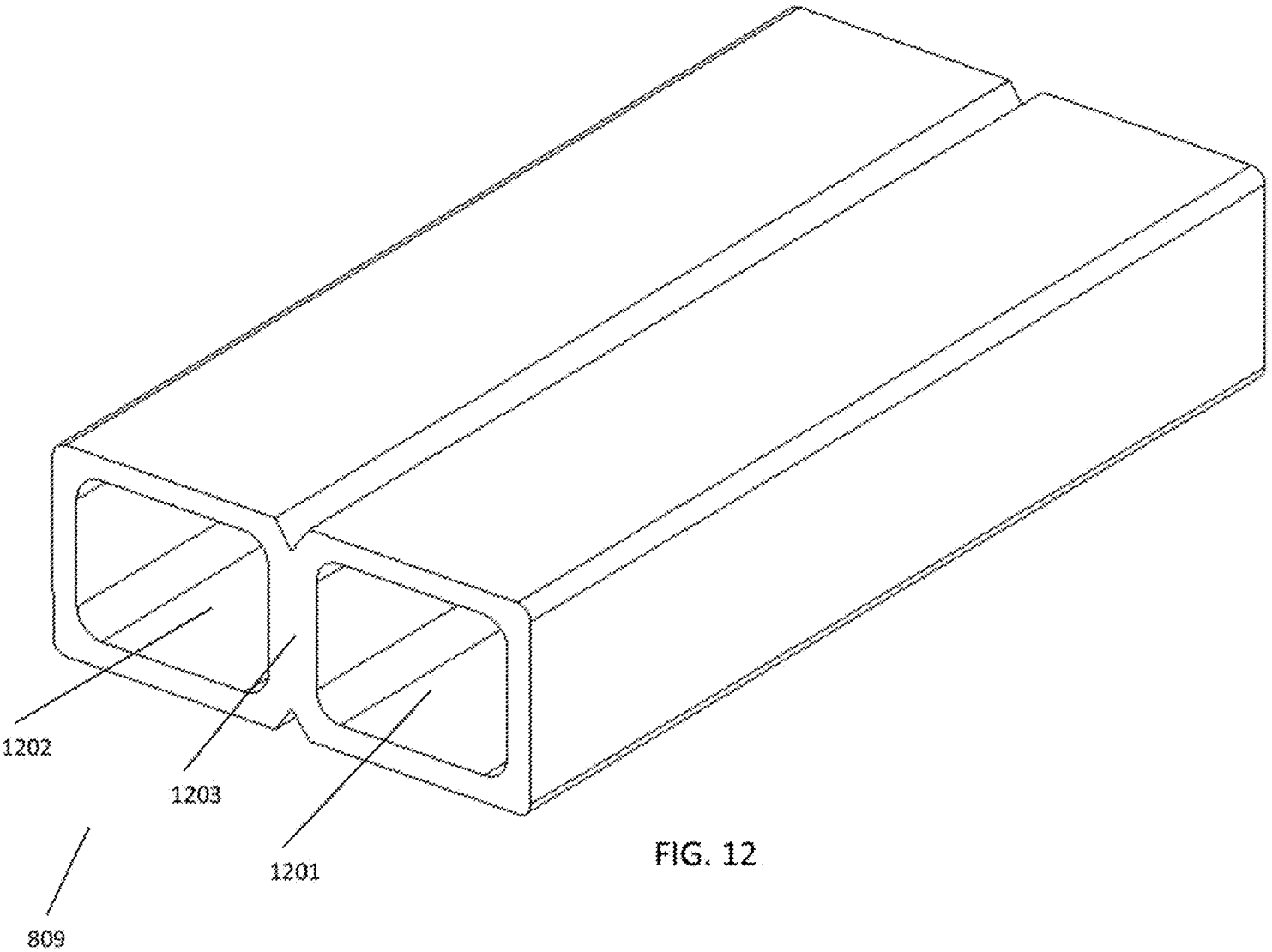
FIG. 12 illustrates an exemplary liquid desiccant supply and return structure comprising two bonded plastic tubes creating a heat exchange effect in accordance with one or more embodiments.

FIG. 12 illustrates a structure 809 for the supply and return of the liquid desiccant to the indoor conditioning unit. The structure comprises a polymer material such as for example an extruded High Density Polypropylene or High Density Polyethylene material the comprises two passages 1201 and 1202 for the supply and return of desiccant respectively. The wall 1203 between the two passages could be manufactured from a thermally conductive polymer, but in many cases that may not be necessary because the length of the structure 809 is by itself sufficient to provide adequate heat exchange capacity between the supply and return liquids.

Having thus described several illustrative embodiments, it is to be appreciated that various alterations, modifications, and improvements will readily occur to those skilled in the art. Such alterations, modifications, and improvements are intended to form a part of this disclosure, and are intended to be within the spirit and scope of this disclosure. While some examples presented herein involve specific combinations of functions or structural elements, it should be understood that those functions and elements may be combined in other ways according to the present disclosure to accomplish the same or different objectives. In particular, acts, elements, and features discussed in connection with one embodiment are not intended to be excluded from similar or other roles in other embodiments. Additionally, elements and components described herein may be further divided into additional components or joined together to form fewer components for performing the same functions. Accordingly, the foregoing description and attached drawings are by way of example only, and are not intended to be limiting.

The invention claimed is:

1. A split liquid desiccant air conditioning system for cooling and dehumidifying an air stream flowing into a space in a building, the split liquid desiccant air conditioning system comprising:

a conditioner located inside the building, said conditioner including a plurality of first structures, each first structure having at least one surface across which a liquid desiccant flows, each first structure including a passage through which a heat transfer fluid flows, wherein the air stream flows between the first structures such that the liquid desiccant dehumidifies and cools the air stream, the conditioner further comprising a sheet of material positioned proximate to the at least one surface of each first structure between the liquid desiccant and the air stream, said sheet of material permitting transfer of water vapor between the liquid desiccant and the air stream;

a regenerator located outside the building connected to the conditioner by liquid desiccant pipes for exchanging the liquid desiccant with the conditioner, said regenerator including a plurality of second structures, each second structure having at least one surface across which the liquid desiccant flows, each second structure including a passage through which the heat transfer fluid flows, said regenerator causing the liquid desiccant to desorb water to an air stream flowing through the regenerator;

an indirect evaporative cooling unit coupled to the conditioner for receiving the heat transfer fluid that has flowed through the first structures and a portion of the air stream that has been dehumidified and cooled by the conditioner, said indirect evaporative cooling unit including a plurality of third structures arranged in a substantially vertical orientation, each third structure having at least one surface across which water is flowed, each third structure including a passage through which the heat transfer fluid from the conditioner is flowed, wherein the portion of the air stream received from the conditioner flows between the third structures such that the water is evaporated by the air stream, resulting in cooling of the heat transfer fluid which is returned to the conditioner, and wherein the air stream treated by the indirect evaporative cooling unit is exhausted to the atmosphere;

an apparatus for moving the air stream through the conditioner and the indirect evaporative cooling unit;

an apparatus for circulating the liquid desiccant through the conditioner and regenerator; and an apparatus for circulating the heat transfer fluid through the conditioner and the indirect evaporative cooling unit; and a heat source for heating the heat transfer fluid in the regenerator.

2. The system of claim 1, wherein the liquid desiccant pipes comprise a first pipe for transferring the liquid desiccant from the conditioner to the regenerator and a second pipe for transferring the liquid desiccant from the regenerator to the conditioner, wherein the first and second pipes are in close contact to facilitate heat transfer from the liquid desiccant flowing in one of the first and second pipes to the liquid desiccant flowing in another of the first and second pipes.

3. The system of claim 2, wherein the first and second pipes comprise an integrally formed structure.

4. The system of claim 3, wherein the integrally formed structure comprises a polymer material.

5. The system of claim 4, wherein at least a wall of the integrally formed structure between the first and second pipes comprises a thermally conductive polymer.

6. The system of claim 1, wherein the conditioner is mounted on a wall inside the building.

7. The system of claim 1, wherein the conditioner has a flat configuration adapted to be hidden behind a computer display, television, or painting.

8. The system of claim 1, wherein the indirect evaporative cooling unit is located inside the building.

9. The system of claim 1, wherein the indirect evaporative cooling unit is located outside the building.

10. The system of claim 1, wherein the heat source for heating the heat transfer fluid in the regenerator comprises a gas water heater, a solar module, a solar thermal/photovoltaic module, or a steam loop.

11. A split liquid desiccant air conditioning system for heating and humidifying an air stream flowing into a space in a building, the split liquid desiccant air conditioning system comprising:

a conditioner located inside the building, said conditioner including a plurality of first structures, each first structure having at least one surface across which a liquid desiccant flows, each first structure including a passage through which a heat transfer fluid flows, wherein the air stream flows between the first structures such that the liquid desiccant humidifies and heats the air stream, the conditioner further comprising a sheet of material positioned proximate to the at least one surface of each first structure between the liquid desiccant and the air stream, said sheet of material permitting transfer of water vapor between the liquid desiccant and the air stream;

a regenerator located outside the building connected to the conditioner by liquid desiccant pipes for exchanging the liquid desiccant with the conditioner, said regenerator including a plurality of second structures, each second structure having at least one surface across which the liquid desiccant flows, each second structure including a passage through which the heat transfer fluid flows, said regenerator causing the liquid desiccant to absorb water from an air stream flowing through the regenerator;

an indirect evaporative cooling unit coupled to the conditioner for receiving the heat transfer fluid that has flowed through the first structures and a portion of the air stream that has been humidified and heated by the conditioner, said indirect evaporative cooling unit including a plurality of third structures arranged, each third structure having at least one surface across which water is flowed, each third structure including a passage through which the heat transfer fluid from the conditioner is flowed, wherein the portion of the air stream received from the conditioner flows between the third structures such that the water vapor is evaporated from the water, resulting in humidification of the air stream, and wherein the air stream treated by the indirect evaporative cooling unit is exhausted inside the building;

an apparatus for moving the air stream through the conditioner and the indirect evaporative cooling unit;

an apparatus for circulating the liquid desiccant through the conditioner and regenerator; and an apparatus for circulating the heat transfer fluid through the conditioner and the indirect evaporative cooling unit; and a heat source for heating the heat transfer fluid in the conditioner and the indirect evaporative cooling unit.

12. The system of claim 11, wherein the liquid desiccant pipes comprise a first pipe for transferring the liquid desiccant from the conditioner to the regenerator and a second pipe for transferring the liquid desiccant from the regenerator to the conditioner, wherein the first and second pipes are in close contact to facilitate heat transfer from the liquid desiccant flowing in one of the first and second pipes to the liquid desiccant flowing in another of the first and second pipes.

13. The system of claim 12, wherein the first and second pipes comprise an integrally formed structure.

14. The system of claim 13, wherein the integrally formed structure comprises a polymer material.

15. The system of claim 14, wherein at least a wall of the integrally formed structure between the first and second pipes comprises a thermally conductive polymer.

16. The system of claim 11, wherein the conditioner is mounted on a wall inside the building.

17. The system of claim 11, wherein the conditioner has a flat configuration adapted to be hidden behind a computer display, television, or painting.

18. The system of claim 11, wherein the indirect evaporative cooling unit is located inside the building.

19. The system of claim 11, wherein the indirect evaporative cooling unit is located outside the building.

20. The system of claim 11, wherein the heat source for heating the heat transfer fluid in the conditioner and the indirect evaporative cooling unit comprises a gas water heater, a solar module, a solar thermal/photovoltaic module, or a steam loop.

* * * * *